US006680583B2

(12) United States Patent
Noda et al.

(10) Patent No.: US 6,680,583 B2
(45) Date of Patent: Jan. 20, 2004

(54) SIGN LAMP LIGHTING TRANSFORMER WITH PROTECTIVE FUNCTIONS

(75) Inventors: Makoto Noda, Gifu (JP); Yoshihiro Nakamura, Gifu (JP); Hideki Shimizu, Gifu (JP); Ikuo Suzuki, Gifu (JP); Daiki Goshima, Gifu (JP); Yoshihiro Matsui, Gifu (JP); Tadayoshi Samura, Gifu (JP); Ryoichi Uda, Gifu (JP); Takahiro Takizuka, Gifu (JP)

(73) Assignee: Lecip Corporation, Gifu (JP)

( * ) Notice: Subject to any disclaimer, the term of this patent is extended or adjusted under 35 U.S.C. 154(b) by 5 days.

(21) Appl. No.: 10/092,606

(22) Filed: Mar. 8, 2002

(65) Prior Publication Data

US 2002/0125837 A1 Sep. 12, 2002

(30) Foreign Application Priority Data

| | | |
|---|---|---|
| Mar. 9, 2001 | (JP) | 2001-066384 |
| Apr. 16, 2001 | (JP) | 2001-116859 |
| May 28, 2001 | (JP) | 2001-158784 |
| Jul. 2, 2001 | (JP) | 2001-200961 |

(51) Int. Cl.[7] ..... H05B 37/02

(52) U.S. Cl. ..... 315/224; 315/290; 315/225; 315/308

(58) Field of Search ..... 315/290, 291, 315/205, 207, 219, 224, 276, 307, 308, 282, 225

(56) References Cited

U.S. PATENT DOCUMENTS

| | | | | |
|---|---|---|---|---|
| 4,629,946 A | * | 12/1986 | Amano et al. | 315/219 |
| 5,019,751 A | * | 5/1991 | Flory, IV et al. | 315/290 |
| 5,142,203 A | * | 8/1992 | Oda et al. | 315/308 |

* cited by examiner

*Primary Examiner*—Wilson Lee
(74) *Attorney, Agent, or Firm*—Connolly Bove Lodge & Hutz LLP

(57) ABSTRACT

An abnormality detection circuit detects abnormality relating to ground fault in secondary winding circuitry of transformer, non-grounding fault of transformer assembly casing or false connection of the AC power source to the transformer assembly in reverse polarity. An interrupter circuit turns a switch off in response to detection of the abnormality by the abnormality detection circuit to interrupt the supply of the AC power to the transformer. When the supply of the AC power is interrupted, the switch is connected to a restart circuit, whereupon the circuit is activated to allow a charging current to flow to a capacitor, which is connected in series in a drive current path of a drive circuit with a time delay on the order of 0.5 to 1.0 second which is determined by a delay circuit thereof. The charging current drives a restoring circuit, which controls the interrupter circuit to its restoring condition temporally so that the switch is turned to its "on" condition only once.

23 Claims, 15 Drawing Sheets

SIGN LAMP LIGHTING TRANSFORMER WITH PROTECTIVE FUNCTIONS

BACKGROUND OF THE INVENTION

The invention relates to a transformer assembly for stepping up an a.c. power for application to sign lamps (cold cathode discharge tubes such as a neon tube or an argon tube) to light it and provided with protective functions against abnormalities such as non-grounding of a neutral point of a transformer casing, a connection to an a.c. power source in reverse polarities and the like.

FIG. 1 shows a conventional lighting transformer assembly with protective functions. Specifically, a transformer 11 includes a primary winding 12, across which a first and a second input terminal 14, 15 are connected, and a secondary winding 13. It will be noted that a power interrupting switch 16 is connected in series between the first input terminal 14 and one end of the primary winding 12. An a.c. power source such as a commercial power supply 17 is connected across the first and second input terminal 14, 15. The opposite ends of the secondary winding 13 are connected to a first and a second output terminal 18, 19, respectively, across which a discharge tube or tubes 21 such as neon tubes or argon tubes are connected.

The a.c. power from the source 17 is fed to the primary winding 12, which steps it up, thus allowing a high tension a.c. power to be supplied from the secondary winding 13 to the discharge tubes 21 in order to light them.

In the event of occurrence of a ground fault on the secondary side such as a connection of the secondary winding 13 to the ground as a result of a contact of a wiring of the discharge tube 21 with a neon tower, such a ground fault is detected by an abnormality detection circuit 22, the arrangement being such that a detection output is applied to an interrupter circuit 23, which is effective to turn the power interrupting switch 16 off to interrupt the supply of the a.c. power to the primary winding 12, thus preventing a continued current flow through the point of ground fault of the secondary side to cause a fire.

A duty is imposed upon transformer such as the transformer 11 mentioned above to connect a transformer casing 24 to the ground before use. If a person forgets to connect a ground terminal 15 of the casing 14 to the ground and the assembly is put to use, this is detected by the abnormality detection circuit 22 to activate the interrupter circuit 23 to turn the switch 16 off. In a similar manner, if the commercial power supply 17 is connected to the first and the second input terminal 14, 15 in reverse polarities, this is again detected by the abnormality detection circuit 22 to turn the switch 16 off. A protective circuit 20 including the abnormality detection circuit 22 which detects the occurrence of one or more of a variety of abnormalities relating to the transformer 11 and the interrupter circuit 23 which turns the switch 16 off to interrupt the supply of the a.c. power to the transformer 11 in response thereto is contained in the transformer casing 24. The interrupter circuit 23 has the function of maintaining the switch 16 off once it is turned off. By way of example, the switch 16 may comprise relay contacts, and a movable contact of the relay is connected to the first input terminal 14 and is arranged to be switched from a normal closed contact $\mathbf{16}_{NC}$ to a normally open contact $\mathbf{16}_{NO}$ to close a self-holding circuit for the relay. The interrupter circuit 23 is connected across the first and the second input terminal 14, 15 to be fed from the a.c. power applied across the first and the second input terminal 14, 15.

A neon sign may be formed by discharge tubes 21 such as neon tubes or argon tubes, which may be flashed to achieve an advertisement effect. At this end, a flasher 10 is connected between the commercial power supply 17 and the first and the second input terminal 14, 15 to interrupt the supply of the a.c. power to the first and the second input terminal 14, 15 in various forms, causing the discharge tubes 21 to be flashed in various forms as a result of such interruption. A conventional arrangement for the abnormality detection circuit 22 and the interrupter circuit 23 which detect the occurrence of a ground fault and interrupts the supply of the input a.c. power is shown in FIG. 2, designating corresponding parts to those shown in FIG. 1 by like reference numerals. In this example, the secondary winding 13 has a midpoint 41 which is connected to the ground terminal 25. A pair of tertiary windings **13*t*1, 13*t*2 which are magnetically coupled to opposite halves located on the both sides of the midpoint 41 of the secondary winding 13 form part of the abnormality detection circuit 22. Normally, the tertiary windings 13*t*1, 13*t*2 are juxtaposed on a magnetic core on which the secondary winding 13 is disposed between the lowermost layers thereof such that a layer of insulating material having a high withstand voltage on the order of 6000–7000 V is interposed between the tertiary windings 13*t*1, 13*t*2 and the secondary winding 13 to provide a high electrical insulation therebetween while allowing a satisfactory magnetic coupling between the secondary winding 13 and the tertiary windings 13*t*1, 13*t*2**.

At their one end, the tertiary windings **13*t*1, 13*t*2, are connected together in an inverse phase relationship so that their induced voltages cancel each other while at their other end, the tertiary windings 13*t*1, 13*t*2 are connected to an input of a rectifying and smoothing circuit 42, the output of which is connected through a Zener diode 46 across a parallel circuit comprising a resistor and a capacitor. The parallel circuit 47 is connected across the gate and the cathode of a triac 30. The triac 30 is connected across the input terminals 14, 15 through a relay drive coil 16*c*, which when energized, controls relay contacts that define the switch 16**.

Under a normal condition, voltages induced across the tertiary windings **13*t*1, 13*t*2 are substantially equal in magnitude, but are opposite in phase, whereby an input voltage to the rectifying and smoothing circuit 42 is nearly zero. However, upon a ground fault of the sign lamps 21 or a wiring thereof, one end of the secondary windings which is associated with the ground fault will be short-circuited to the midpoint 41, causing a substantial decrease in the induced voltage in the tertiary winding which is coupled with this secondary winding 13 to allow the full induced voltage across the other tertiary winding to be applied to the rectifying and smoothing circuit 42. This voltage is rectified and smoothed and an increase in the rectified and smoothed output voltage turns the Zener diode 46 on, with consequence that the triac 30 is turned on to energize the relay drive coil 16*c* to open the switch 16, thus interrupting the supply of the input a.c. power to the transformer 11. The movable contact of the switch 26 comprising the relay contacts is thrown to the normally open position $\mathbf{16}_{NO}$, whereby the holding current to the relay drive coil 16*c*** flows.

A ground fault protective circuit is shown in FIG. 3, with corresponding parts to those shown in FIG. 2 being designated by like reference characters as used before. Specifically, the midpoint 41 of the secondary winding 13 is connected to the ground terminal 25 through a rectifying diode 37 and a series circuit including a Zener diode 38 and a light emitting element $\mathbf{55}_{PE}$ of a photocoupler 55. The midpoint 41 of the secondary winding is also connected through a resistive element 39 to the ground terminal 25. A series circuit including the relay drive coil 16*c* and a light receiving element $\mathbf{55}_{PR}$ of the photocoupler 55 is connected across the input terminals 14 and 15. It is to be noted that on the opposite sides of the midpoint 41, the secondary winding 13 is wound in the opposite directions.

Normally, the potentials at the output terminals 18 and 19 alternate between positive and negative maximum values in mutually phase opposition relationship, while the potential at the midpoint 41 remains substantially equal to zero. However, if a ground fault occurs on one of the output terminals, for example, at terminal 18, this output terminal 18 assumes a substantially zero potential, and the potential at the output terminal 19 alternates with respect to the ground with an amplitude which is nearly twice the potential during a normal operation, with consequence that the potential at the midpoint 41 alternates. The resulting potential of the midpoint 41 is rectified by the diode 37 to produce a current flow through the light emitting element $\mathbf{55}_{PE}$ through the Zener diode 38, causing the element $\mathbf{55}_{PE}$ to emit light, which is then received by the light receiving element $\mathbf{55}_{PR}$ to conduct, thus allowing a current flow through the relay coil 16*c* to cause the contact 16 to be switched from the normally closed position to the normally open position, thus interrupting the supply of the a.c. power to the primary winding 12.

In order to facilitate locating a site where the fault has occurred, the transformer is provided with protective function disable means 27 as shown in FIG. 1. Specifically, if a protective function disable switch 28 is turned on when the protective circuit 20 functions to interrupt the switch 16, the protective function disable circuit 29 is activated to override or invalidate a self-holding circuit, not shown, which is contained in the interrupter circuit 23. For example, in the arrangement of FIG. 2, the series circuit including the movable contact of the switch 16, the normally open contact $\mathbf{16}_{NO}$, the resistive element 57 and the relay coil 16*c* is interrupted, and the power interrupting switch 16 is thrown to the normally closed contact $\mathbf{16}_{NC}$ to allow the a.c. power to be supplied to the primary winding 12. When the switch 16 which is once interrupted in response to the ground fault is restored in this manner, there occurs a current flow through the site of ground fault, producing sparks or ozone, which can be relied upon to locate the site of ground fault in a relatively simple manner.

An appearance of sign lamps lighting transformer with protective functions of the kind described is shown in FIG. 4. Specifically, the transformer casing 24 which is rectangular has one end plate on which the first and the second input terminal 14, 15, one output terminal 19, the casing ground terminal 25, and an operating knob 28*p* of the protective function disable switch 28 are mounted and the other end plate on which the other output terminal 18 is mounted to project therefrom.

As shown in FIG. 5, the protective function disable switch 28 is mounted on the inner surface of the end plate 24*a* of the transformer casing 24, and the operating knob 28*p* projects externally through a small opening formed in the end plate 24*a*. A wiring substrate 35 is disposed within the transformer casing 24 in opposing relationship with the inner surface of the end plate 24*a*, and while not shown, the protective circuit 20 and the protective function disable circuit 29 are mounted on the substrate, with the protective function disable switch 28 being connected to the protective function disable circuit 29 through a lead wire 36.

SUMMARY OF THE INVENTION

It is an object of the present invention to provide a sign lamp lighting transformer assembly with protective functions which is capable of maintaining protective functions if the power supply to a transformer is interrupted by a flasher.

It is another object of the present invention to provide a sign lamp lighting transformer assembly with protective functions which is capable of automatically eliminating a malfunctioning of the protective circuit while allowing a site of ground fault to be located in a facilitated manner.

It is a further object of the present invention to provide a sign lamp lighting transformer assembly with particular functions which facilitates the operation of a protective function disable switch.

It is an additional object of the present invention to provide a sign lamp lighting transformer assembly with protective functions which prevents a malfunctioning for a ground fault and reliably detects a true ground fault.

According to a first aspect of the present invention, a sign lamp lighting transformer assembly with protective functions also comprises a third input terminal, and an interrupter circuit is connected between the third input terminal and one of the input terminals which is not connected to a power interrupter switch, and an a.c. power source is connected across these input terminals so that the interrupter circuit can be fed if the supply of the a.c. power to the primary winding is interrupted.

According to a second aspect of the present invention, a sign lamp lighting transformer assembly with protective functions comprises a restart circuit which is automatically operative whenever a power interrupting switch is turned off by a protective circuit to restore the power interrupting switch to its on condition only once after a brief interval on the order of 0.5 to 1.0 second.

The restart circuit may comprise a drive circuit and a restoring circuit, for example. The drive circuit includes a series capacitor in its current path, and is activated whenever the power interrupting switch is turned off to allow a charging current to flow through the capacitor, and an interrupter circuit is controlled in a manner such that the current flow through the capacitor drives the restoring circuit to turn the power interrupting switch on.

According to a third aspect of the present invention, a sign lamp lighting transformer assembly with protective functions comprises an operating knob for a protective function disable switch which is mounted on a surface of a transformer casing other than the surfaces on which input terminals and/or output terminals are mounted.

According to a fourth aspect of the present invention, a sign lamp lighting transformer assembly with protective functions comprises a rectifier circuit which converts an input a.c. power into a d.c. power, which is then converted into a high frequency high tension power through an inverter and a transformer for application to a sign lamp. A rectifying element and a resistive element are connected in series between the midpoint of a secondary winding of the transformer and a negative output of the rectifier circuit, and a current flow through the resistive element is detected by a detection circuit to be subject to a decision by a decision circuit to see if the detected current has exceeded a given value. If a decision is rendered that the current has exceeded the given value, the operation of the inverter is stopped by a stop circuit in response to the decision.

DESCRIPTION OF EMBODIMENTS

Figure 1:
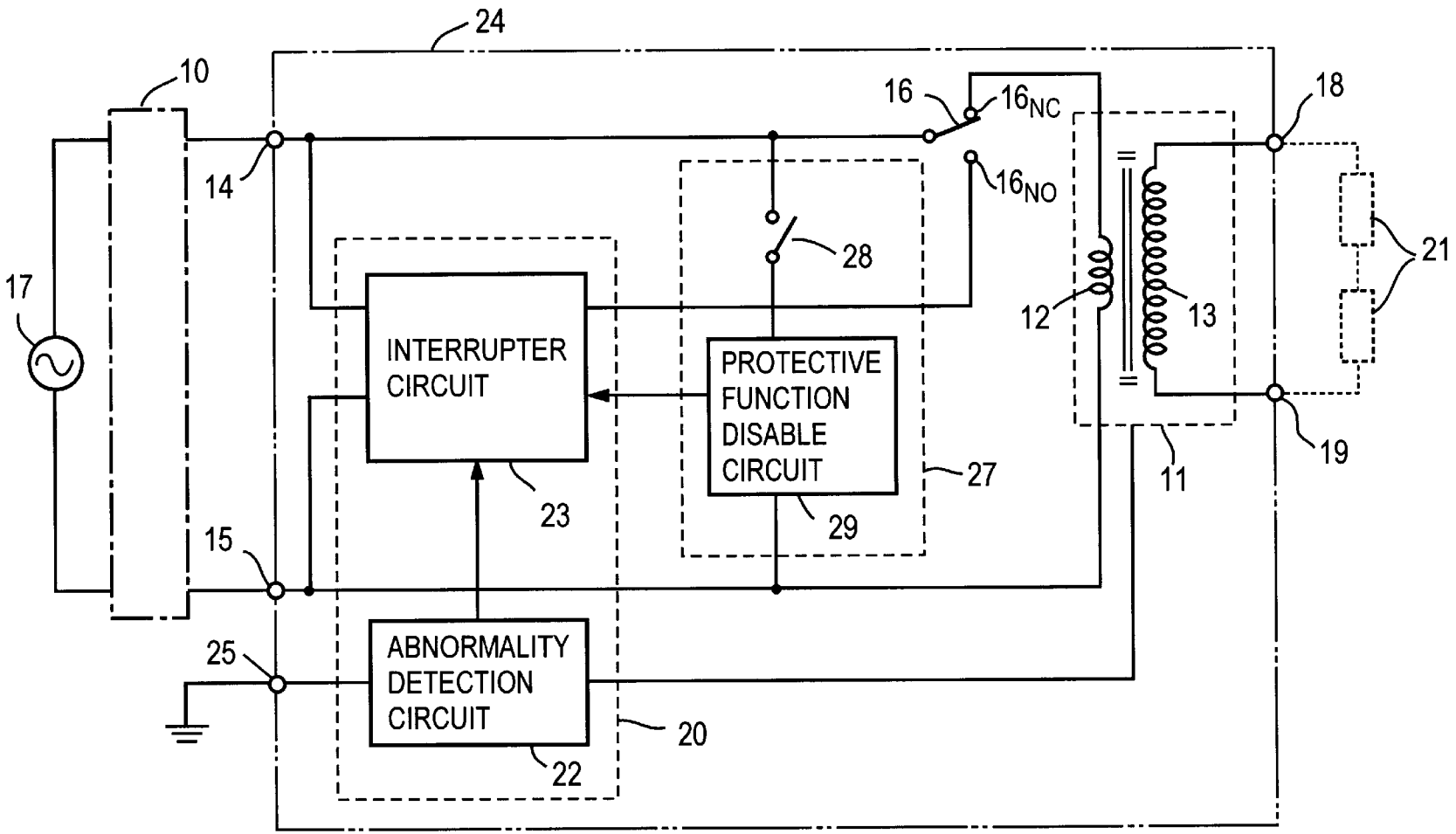
FIG. 1 PRIOR ART
FIG. 1 is a circuit diagram of a conventional sign lamp lighting transformer assembly with protective functions.
Figure 2:
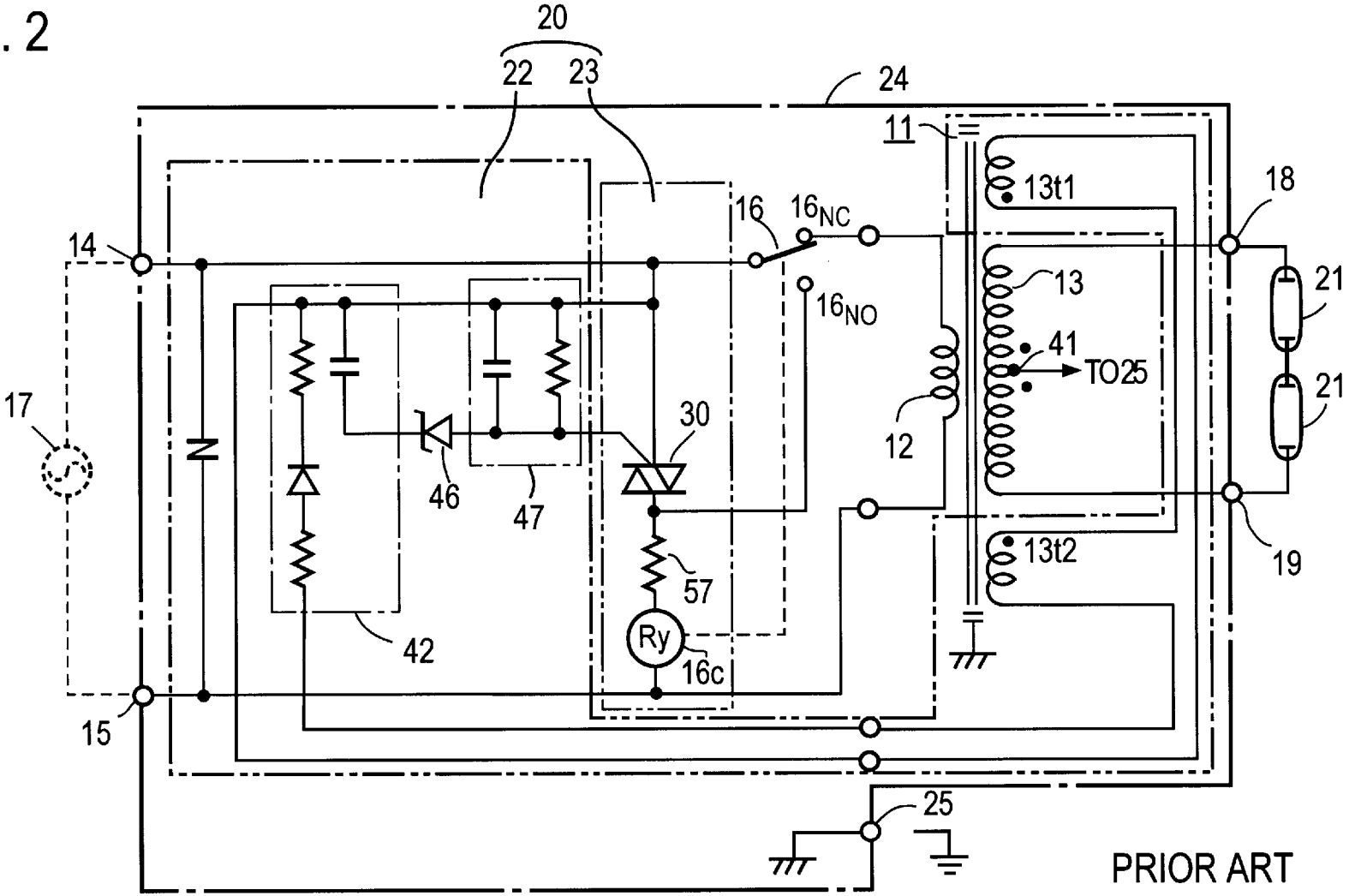
FIG. 2 is a circuit diagram of another conventional sign lamp lighting transformer assembly with protective functions.
Figure 6A:
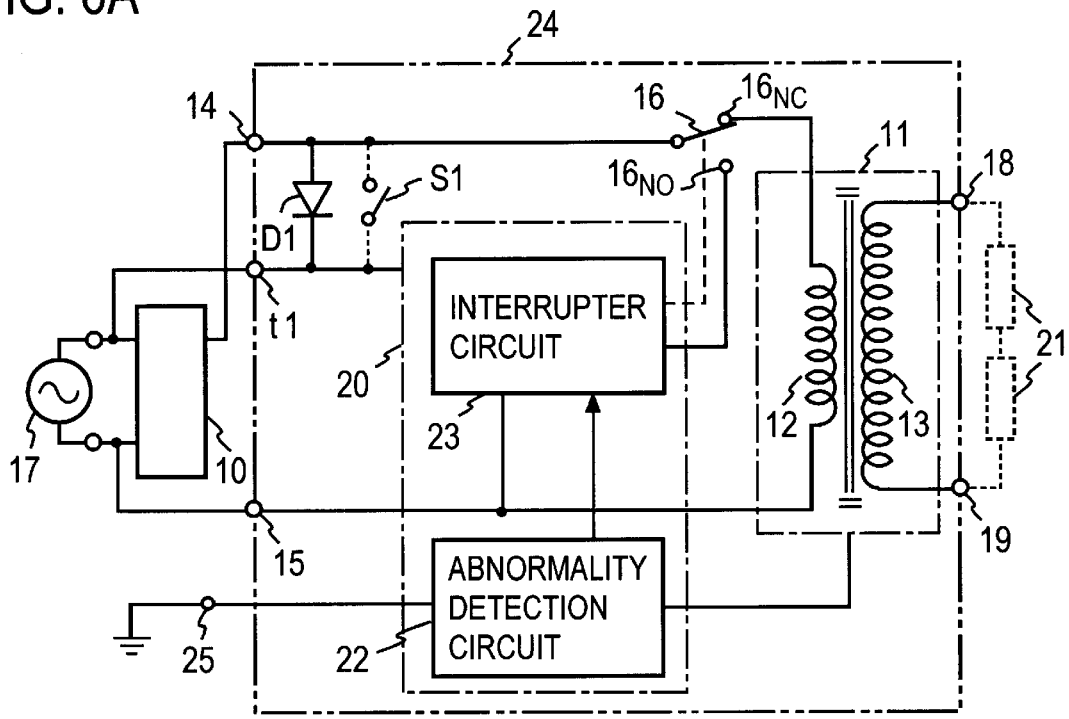
FIG. 6A is a circuit diagram of an embodiment according to the first aspect of the present invention, illustrating the connection of a flasher.
Figure 6B:
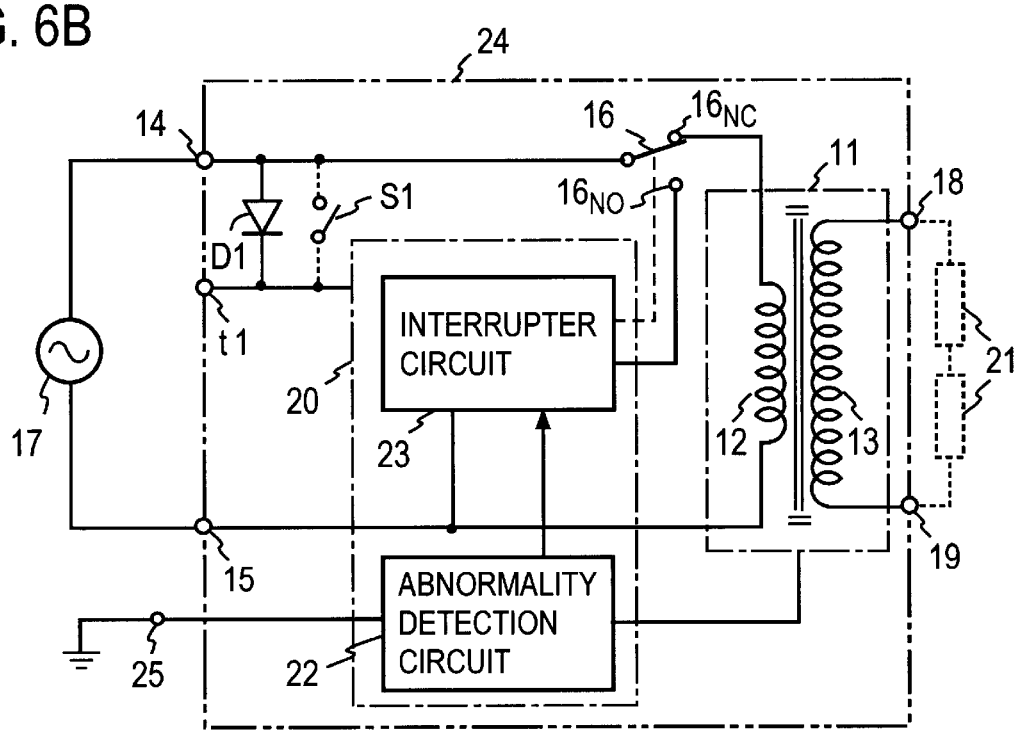
FIG. 6B is a circuit diagram of an embodiment according to the first aspect of the present invention in which a flasher is not connected.

An embodiment according to the first aspect of the present invention is shown in FIG. 6, using same reference characters as used before for parts corresponding to those shown in FIG. 1. According to the first aspect of the present invention, a third input terminal t1 is provided in addition to a first and a second input terminal 14, 15. An interrupter circuit 23 is connected between the second input terminal 15 which is not connected with an interrupting switch 16 and the third input terminal t1. A commercial power supply 17 is connected between the second and the third input terminal 15, t1. The interrupter circuit 23 is fed from the a.c. power applied across the second and the third input terminal 15, t1. The first and the second input terminal 14, 15 are used to supply the a.c. power to the primary winding 12 of a transformer 11. Accordingly, the commercial power supply is connected across the first and the second input terminal 14, 15 either through a flasher 10 as shown in FIG. 6A or directly as shown in FIG. 6B.

In this embodiment, a diode D1 is connected between the first input terminal 14 which is connected to the interrupting switch 16 and the third input terminal t1, with the anode connected to the terminal 14.

With the arrangement shown in FIG. 6A, if the supply of the a.c. power to the primary winding 12 is interrupted by the flasher 10 when an abnormality detection circuit 22 detects the occurrence of an abnormality to activate the interrupter circuit 23 to turn the power interrupting switch 16 off, the a.c. power continues to be supplied to the interrupter circuit 23 through the second and the third input terminal 15, t1, thus maintaining the switch 16 off to assure the operation of the protective function.

When the flasher 10 is not used, the commercial power supply 17 may be directly connected across the first and the second input terminal 14, 15, as shown in FIG. 6B. The operating power is supplied to the interrupter circuit 23 from the first input terminal 14 through the diode D1, thus operating the interrupter circuit 23. In this manner, a connection between the commercial power supply 17 and the third input terminal t1 is dispensed with. As indicated in broken lines in FIG. 6, the diode D1 may be replaced by a switch S1 connected between the first and the third input terminal 14, t1 to turn the switch S1 on when the flasher 10 is not used. Usually, a switch operation is simpler than connecting the commercial power supply 17 with the third input terminal t1.

Figure 7:
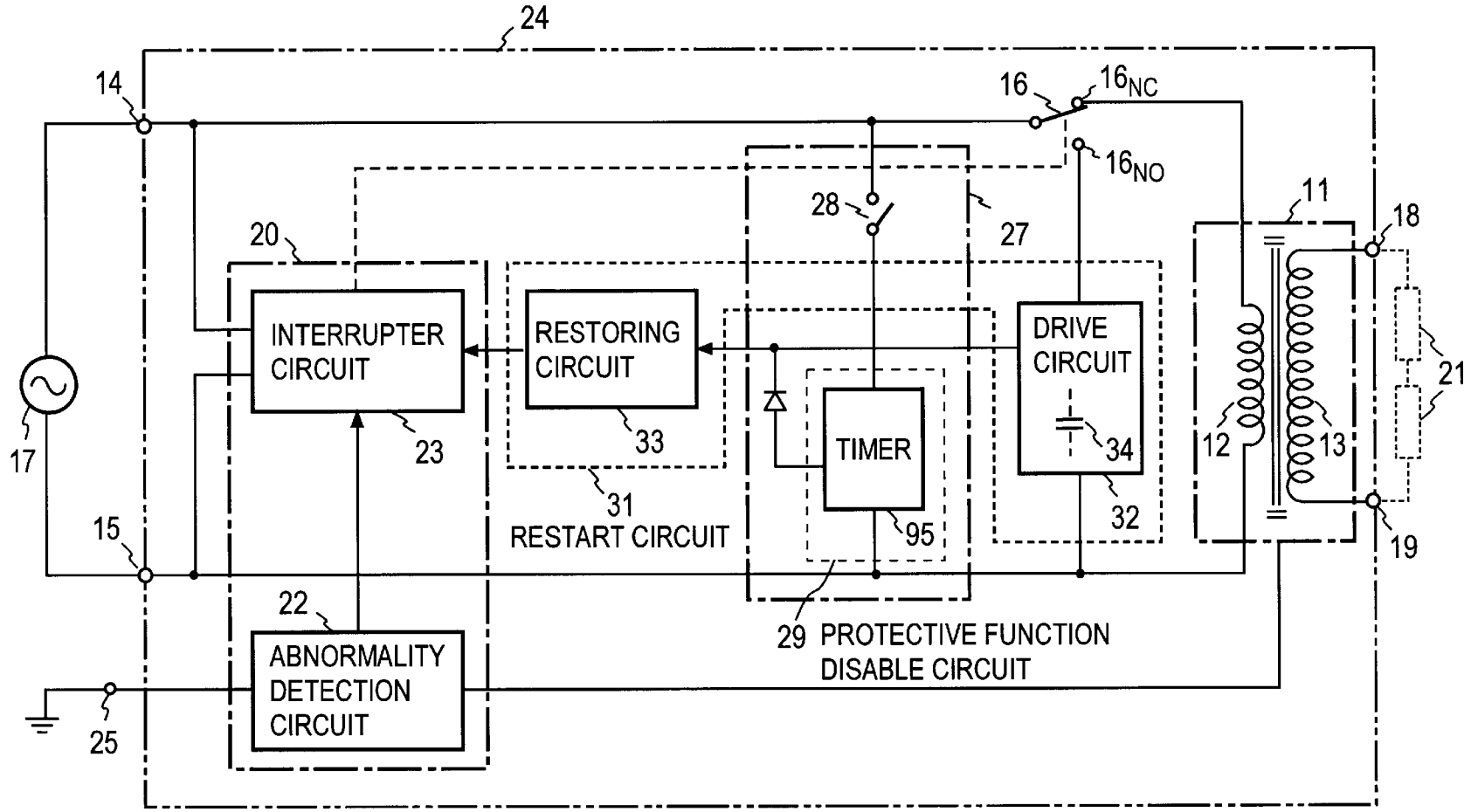
FIG. 7 is a circuit diagram of an embodiment according to the second aspect of the present invention.

FIG. 7 shows an embodiment according to the second aspect of the present invention, with parts corresponding to those shown in FIG. 1 being designated by like reference characters as used before. According to the second aspect of the present invention, there is provided a restart circuit 31. In the example shown, a normally open contact $\mathbf{16}_{NO}$ of the power interrupting switch 16 is connected to the restart circuit 31. When an abnormality is detected, the interrupter circuit 23 interrupts the power interrupting switch 16. In the present example, the movable contact of a relay switch which constitutes the power interrupting switch 16 is thrown from the normally closed contact $\mathbf{16}_{NC}$ to the normally open contact $\mathbf{16}_{NO}$, the a.c. power source 17 is connected to the restart circuit 31 to activate it, which then controls the interrupter circuit 23 to restore the power interrupting switch 16 from its off to its on condition. The restoring operation takes place only once.

The restart circuit 31 may comprise a drive circuit 32 and a restoring circuit 33, for example. The drive circuit 32 includes a capacitor 34 and a delay circuit, not shown. When the switch 16 is thrown to the normally open contact $\mathbf{16}_{NO}$, a charging current begins to flow through the capacitor 34 with a delay on the order of 0.5 to 1.0 second. A drive current which results from the charging current drives the restoring circuit 33, which controls the interrupter circuit 23 so as to restore the on condition of the power interrupting switch 16. Accordingly, if the protective circuit 20 operates as a result of a temporary abnormality such as the influence of a wind, for example, which causes a temporary ground fault of the secondary side of the transformer 11 or as a result of a temporary malfunctioning, the normal condition is resumed when the automatic restoring operation takes place, providing a high possibility that the sign lamps 21 can be lit again.

The embodiment shown includes protective function disable means 27 associated with a protective function disable switch 28. When the protective function disable switch 28 is operated, the protective function disable circuit 29 which includes a timer 95 is activated to provide an output, which drives the restoring circuit 33. The drive continues over a time length until the timer 95 in the protective function disable circuit 29 times out. Accordingly, as long as the drive is continued, the restoring circuit 33 controls the interrupter circuit 23 to maintain the power interrupting switch 16 on.

In this manner, by restoring the power interrupting switch 16 which is interrupted in response to a ground fault, for example, to its on condition for a given time interval to allow a ground fault current to flow, the detection of a site of ground fault in terms of resulting sparks or ozone is facilitated.

Figure 8:
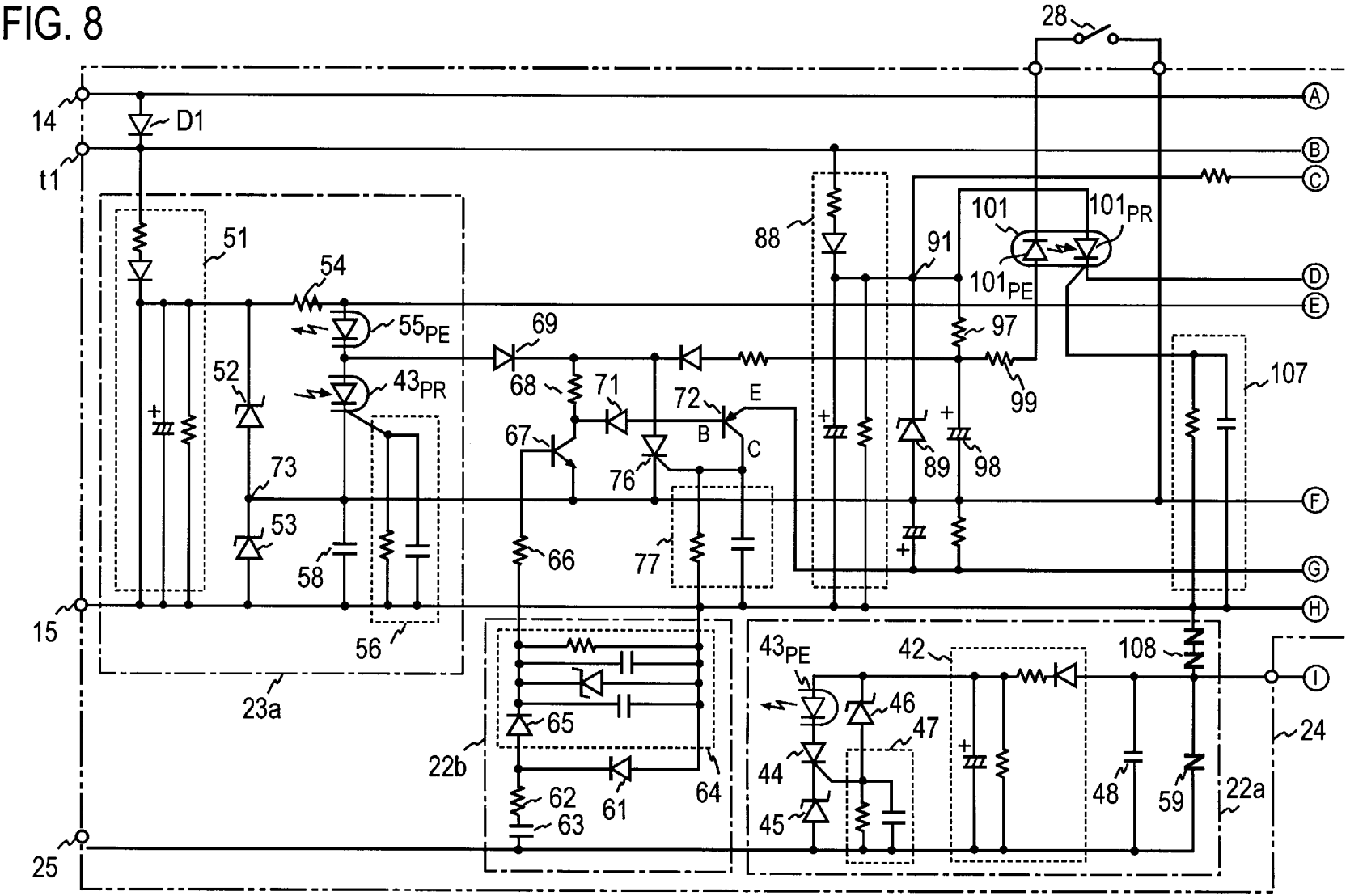
FIG. 8 is a circuit diagram of one-half of a specific example of the embodiment shown in FIG. 6 to which the functions illustrated in FIG. 7 are added.
Figure 9:
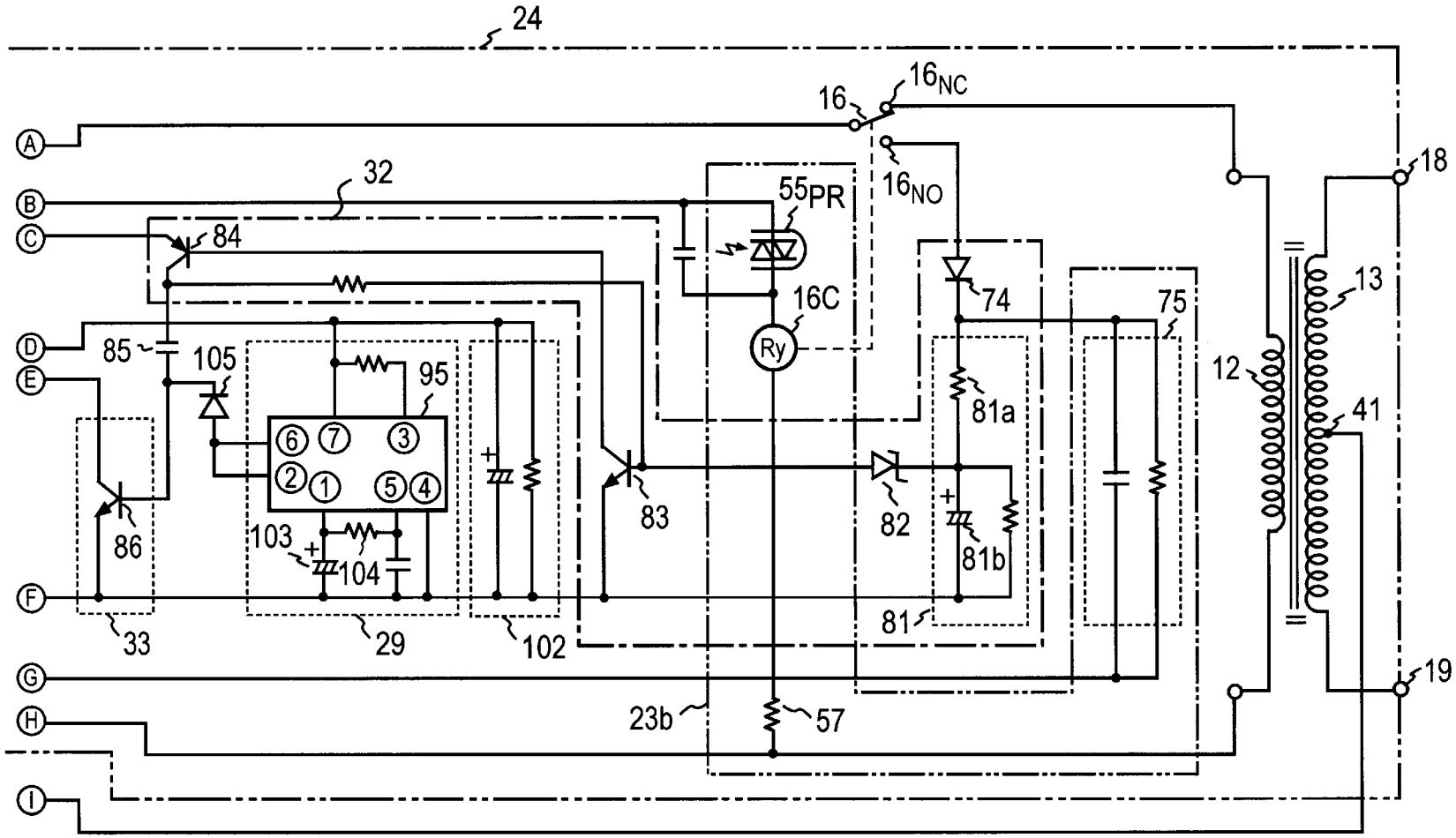
FIG. 9 is a circuit diagram showing the other half of the example shown in FIG. 8.

FIGS. 8 and 9 show a specific example for the abnormality detection circuit 22 and the interrupter circuit 23 shown in FIG. 6 and the restart circuit 31 and the protective function disable means 27 shown in FIG. 7, or the arrangement shown in FIG. 6 to which the restart circuit 31 and the protective function disable means 27 are added. In this instance, the abnormality detection circuit 22 comprises a ground fault detection circuit 22*a* and a non-grounding detection circuit 22*b*. The arrangement is shown split into FIGS. 8 and 9 because the entire arrangement cannot be shown on a single drawing, it being understood that lines designated by alphabetical letters on the right end in FIG. 8 are connected to corresponding lines designated by corresponding alphabetical letters appearing on the left end of FIG. 9.

Ground Fault Detection Circuit

In the ground fault detection circuit 22*a* (FIG. 8), the midpoint 41 of the secondary winding 13 is connected to an input end of a rectifying and smoothing circuit 42 including a diode, a resistive element and a capacitor. The other input and one end of the output of the rectifying and smoothing circuit 42 are connected to a casing ground terminal 25. A series circuit including a light emitting element $\mathbf{43}_{PE}$ of a photocoupler 43, a thyristor 44 and a Zener diode 45 is connected across the output ends of the rectifying and smoothing circuit 42, and a Zener diode 46 is connected between the gate of the thyristor 44 and the junction between the light emitting element $\mathbf{43}_{PE}$ and the rectifying and smoothing circuit 42. The gate of the thyristor 44 is connected to the casing ground terminal 25 through a malfunctioning preventing circuit 47 which comprises a capacitor and a resistive element and which prevents a malfunctioning caused by noises from occurring. The purpose of the Zener diode 45 is to prevent a malfunctioning caused by noises from occurring by applying a bias to the gate of the thyristor 44.

A capacitor 48 is connected in shunt with the input of the rectifying and smoothing circuit 42 in order to prevent a malfunctioning of the ground fault detection circuit 22*a* from occurring as a result of a relatively large leak current through a floating capacitance when a metal conduit is used for the wiring on the secondary side, by passing such leak current to the ground through the capacitor 48. The capacitor 48 may be replaced by a resistive element.

The interrupter circuit 23 is split into a circuit 23*a* shown in FIG. 8 and a circuit 23*b* shown in FIG. 9. In the interrupter circuit 23, a power supply rectifying and smoothing circuit 51 is connected between a third input terminal t1 and a second input terminal 15, and a series circuit including a pair of Zener diodes 52, 53 is connected across the output of the rectifying and smoothing circuit 51, thus providing a given constant voltage across the Zener diode 52. A series circuit including a light emitting element $\mathbf{55}_{PE}$ of a photocoupler 55 and a photo-thyristor $\mathbf{43}_{PR}$ which acts as a light receiving element of the photocoupler 43 is connected across the Zener diode 52 through a resistive element 54. The gate of the photo-thyristor $\mathbf{43}_{PR}$ is connected to the second input terminal 15 through a circuit 56 which prevents a malfunctioning due to noises. A series circuit including a photo-triac $\mathbf{55}_{PR}$ which acts as a light receiving element of the photocoupler 55, a relay coil 16C for driving a relay contact $\mathbf{16}_{M}$ and a resistive element 57 is connected between the third input terminal t1 and the second input terminal 15, as shown in FIG. 9. A capacitor 58 is connected in parallel with the Zener diode 53 (FIG. 8).

When the secondary winding 13 of the transformer 11 is normal, a stepped-up a.c. power is generated across the output terminals 18 and 19. Thus, the potential at the output terminal 18 alternates between $+V_H$ and $-V_H$ every half period of the a.c. power while the potential at the output terminal 19 alternates between $-V_H$ and $+V_H$, and the midpoint 41 of the secondary winding 13 normally assumes a zero potential. However, if one half of the secondary winding 13, for example, a wiring located toward the terminal 18 moves into contact with the ground, the point of contact and the ground assumes substantially zero potential, and the potential at the midpoint 41 alternates substantially between $\pm V_H$. An a.c. voltage which is developed between the midpoint 41 and the ground terminal 25 is rectified and smoothed by the rectifying and smoothing circuit 42, with a rectified and smoothed output voltage exceeding a given value to render the Zener diode 46 conductive, which in turn renders the thyristor 44 conductive to allow the light emitting element $\mathbf{43}_{PE}$ to emit light, and the resulting light is received by the photo-triac $\mathbf{55}_{PR}$ to render the photo-triac $\mathbf{55}_{PR}$ conductive to pass a current flow through the relay coil 16C, thus switching the relay contact $\mathbf{16}_{M}$ from the normally closed contact $\mathbf{16}_{NC}$ to its normally open contact $\mathbf{16}_{NO}$. In other words, the power interrupting switch 16 is turned off, thus interrupting the supply of a.c. power to the primary winding 12. The photo-thyristor $\mathbf{43}_{PR}$ remains conductive once it conducts unless the power supply is interrupted. Accordingly, the switch 16 is maintained in its off condition, preventing a ground fault current from continuing to flow. A surge absorber 59 is connected in parallel with the capacitor 48 to prevent the ground fault detection circuit 22*a* from malfunctioning in response to a surge voltage and preventing the ground fault detection circuit 22*a* from being destroyed.

Non-Grounding Detection Circuit

The non-grounding detection circuit 22*b* will now be described. The second input terminal 15 is connected to the ground terminal 25 through a diode 61, a resistive element 62 and a capacitor 63. A rectifying and smoothing circuit 64 is connected across the diode 61. The anode of the diode 61 is connected to one end each of the input and output of the rectifying and smoothing circuit 64. The rectifying and smoothing circuit 64 includes a diode 65 having an anode which is connected to the cathode of the diode 61. The other output end of the rectifying and smoothing circuit 64 is connected to the base of an npn transistor 67, the collector of which is connected to the junction between the photo-thyristor $\mathbf{43}_{PR}$ and the light emitting element $\mathbf{55}_{PE}$ through a resistive element 68 and a back flow blocking diode 69 and is also connected to the base of a pnp transistor 72 through a back flow blocking diode 71. The emitter of the transistor 67 is connected to the junction between the Zener diodes 52 and 53. The normally open contact $\mathbf{16}_{NO}$ of the relay is connected through a diode 74, and a parallel circuit 75 including a resistive element and a capacitor to the emitter of the pnp transistor 72, the collector of which is connected to the gate of the thyristor 76 and also connected through a parallel circuit 77 including a resistive element and a capacitor to the second input terminal 15. The anode of the thyristor 76 is connected to the junction between the resistive element 68 and the diode 69 while its cathode is connected to the junction 73. In order to allow the no ground connection of the ground terminal 25 to be detected, an arrangement is made such that voltages induced across the secondary winding 13 of the transformer 11 is a little unbalanced with respect to the midpoint 41. For example, an unbalance between a magnetic circuit for flux produced by a current flow through a winding located on one side of the midpoint 41 of the secondary winding 13 and a magnetic circuit for flux produced by a current flow through the other winding can be produced by splitting the secondary winding 13 into two parts which are disposed on opposite sides of the midpoint 41 on a magnetic core on which the primary winding 12 of the transformer 11 is disposed, and providing a different thickness for a leakage magnetic core which is provided between the primary winding 12 and each split winding of the secondary winding 13.

It is recognized that one end of the commercial power supply 17 is usually grounded, and a terminal which is connected to the grounded side is referred to as a nonactive terminal. In the example shown, the second input terminal 25 represents a nonactive terminal. When the grounded terminal 25 is connected to the ground, the potential at the emitter of the transistor 67 is higher than the ground potential by the Zener voltage of the Zener diode 53 while the ground terminal 25 assumes the ground potential. Since the output of the rectifying and smoothing circuit 64 assumes the ground potential, the transistor 67 remains nonconductive. However, when the ground terminal 25 is not connected to the ground, a voltage is developed at the midpoint 41 due to the unbalance of the secondary winding 12 with respect to the midpoint 41, and is rectified by the rectifying and smoothing circuit 64 to provide a rectified output which renders the transistor 67 conductive. When the transistor 67 conducts, there occurs a current flow through the light emitting element $\mathbf{55}_{PE}$ to turn the photo-triac $\mathbf{55}_{PR}$ on to drive the relay drive coil 16C, whereby the relay contact $\mathbf{16}_{M}$ is switched to its normally open contact $\mathbf{16}_{NO}$, thus turning the switch 16 off. The conduction of the transistor 67 permits the pnp transistor 72 to conduct. The switch contact 16 is connected to the normally open contact $\mathbf{16}_{NO}$, and the a.c. power across the first input terminal 14 and the second input terminal 15 is rectified by the diode 74 to be fed to the emitter of the pnp transistor 72 through the parallel circuit 75, allowing the base current of the transistor 72 to flow through the diode 71 and the transistor 67, thus delivering a collector current of the transistor 72. This output turns the thyristor 76 on, whereupon a current continues to flow through the light emitting element $\mathbf{55}_{PE}$ through the thyristor 76, maintaining the switch 16 off.

The no ground connection detection circuit 22*b* also turns the transistor 67 on for an inadvertence that the grounded side of the commercial power supply 17 is connected to the first input terminal 14, and thus in a wrong polarity connection, similarly turning the switch 16 off and maintaining it off.

Restart Circuit (Automatic Abnormality Confirmation Function)

A junction between the diode 74 (FIG. 9) and the parallel circuit 75 is connected to a CR delay circuit (or time constant circuit) 81. Thus, the junction is connected through a resistive element 81*a* to the cathode of a Zener diode 82 and connected through a capacitor 81*b* to the junction 73. The anode of the Zener diode 82 is connected to the base of an npn transistor 83, the collector of which is in turn connected to the base of a pnp transistor 84. The emitter of the transistor 83 is connected to the junction 73, and the collector of the pnp transistor 84 is connected through a capacitor 85 to the base of an npn transistor 86. A power supply rectifying and smoothing circuit 88 is connected between the third input terminal t1 and the second input terminal 15, and a constant voltage Zener diode 89 is connected between an output 91 of the rectifying and smoothing circuit 88 and the junction 73. The emitter of the transistor 84 (FIG. 9) is also connected to the output terminal 91 of the rectifying and smoothing circuit 88. In this manner, the drive circuit 32 is constructed. The collector of the transistor 86 is connected to the junction between the resistive element 54 and the light emitting element $\mathbf{55}_{PE}$, and its emitter is connected to the junction 73, thus forming the restoring circuit 33.

When the abnormality detection circuit 22 (either circuit 22*a* or 22*b*) detects an abnormality, and the light emitting element $\mathbf{55}_{PE}$ emits light, the photo-triac $\mathbf{55}_{PR}$ is turned on to drive the relay coil 16C, whereby the relay contact $\mathbf{16}_{M}$ is thrown to the normally open contact $\mathbf{16}_{NO}$ to cease the supply of the a.c. power to the primary winding 12. The a.c. power applied to the normally open contact $\mathbf{16}_{NO}$ is then rectified by the diode 74, and the rectified output is passed through the delay circuit 81 to be applied to the Zener diode 82. The voltage across the Zener diode 82 rises gradually in accordance with the time constant determined by the delay circuit 81, and after the switch 16 is tunred off, for example, after a time interval on the order of 0.5 to 1.0 second, the Zener diode 82 conducts, in turn allowing the transistor 83 to conduct, which in turn allows the transistor 84 to conduct, causing a charging current to flow from the transistor 84 to the capacitor 85. The current further flows into the base of the transistor 86. In other words, the drive circuit 32 drives the restoring circuit 33 to render the transistor 86 conductive, whereupon the transistor 86 short-circuits across the light emitting element $\mathbf{55}_{PE}$ and the photo-thyristor $\mathbf{43}_{PR}$, thus rendering the photo-thyristor $\mathbf{43}_{PR}$ nonconductive. Accordingly, the light emitting element $\mathbf{55}_{PE}$ ceases to emit light, and the restoring circuit 32 turns the photo-triac $\mathbf{55}_{PR}$ off, whereby the drive current ceases to flow through the relay coil 16C, thus throwing the relay contact $\mathbf{16}_{M}$ to the normally closed contact $\mathbf{16}_{NC}$ or turning the switch 16 on, resuming the supply of the a.c. power to the primary winding 12. In this manner, the interrupter circuit 23 is controlled by the restoring circuit 32 SO that the power interrupting switch which has been turned off is restored to its on condition. It will be noted that when the transistor 84 conducts, the conducting current is also fed to the base of the transistor 83, thus maintaining it conductive, whereby the capacitor 85 continues to be charged from the transistor 84.

When the a.c. power is supplied to the primary winding 12 again at a short time interval after the supply of the a.c. power to the primary winding 12 has been interrupted in response to the detection of the occurrence of an abnormality by the abnormality detection circuit 22, if the abnormality which was detected by the abnormality detection circuit 22 were removed, the sign lamp 21 lighting operation takes place. Thus, if the abnormality were caused by a temporary malfunctioning of the abnormality detection circuit 22 caused by noises or a temporary ground fault which might have occurred as a result of the wind driving a dust into contact between the secondary winding 13 and the ground, there is a high possibility that such an abnormality may be removed before the a.c. power is resupplied to the primary winding 12 to allow a normal lighting operation to take place automatically.

On the other hand, if the detected abnormality does not remain to be temporary, but is persistent, when the described operation of the restart circuit 31 causes the a.c. power to be resupplied to the primary winding 12, the abnormality detection circuit 22 again detects the abnormality to operate the interrupter circuit 23, whereby the relay contact $\mathbf{16}_M$ is thrown to the normally open contact $\mathbf{16}_{NO}$ to cease the supply of the a.c. power to the primary winding 12. Again the a.c. power is applied to the normally open contact $\mathbf{16}_{NO}$ to render the transistor 83 and 84 conductive, but the capacitor 85 remain charged as it is charged during the previous conduction of the transistor 84, and thus, there is no current through the transistor 86 which charges the capacitor 85. Accordingly, there is no drive current from the drive circuit 32, and the restoring circuit 33 does not perform a restoring operation. Accordingly, the drive current remains flowing through the relay coil 16C, maintaining the switch 16 off.

In this example, the capacitor 85 is connected in series in the drive current path, and a charging current of the capacitor 85 renders the transistor 86 conductive or drives the restoring circuit 33. The capacitor 85 is not limited in its connection to the collector of the transistor 84, but may be connected in series with either the emitter or base thereof, or may also be connected in series with the emitter of the transistor 83. In any event, when the switch 16 is turned off in response to the initial detection of an abnormality, the transistor 83 is rendered conductive to provide a charging current for the capacitor 85, and the transistor 86 is driven in response to the charging current. If the switch 16 is turned off in response to the next detection of an abnormality, and the voltage across the capacitor 81*b* increases, because the capacitor 85 is already charged, there is no charging current for the capacitor 85, and thus there is no drive current for the transistor 86.

Protection Disable Function

When a ground fault, for example, occurs, it is a customary practice to disable the protective function against the ground fault by supplying the a.c. power to the primary winding 12 to reestablish a ground fault current in order to facilitate locating a site of ground fault. An example which provides such a function will be described.

A protective function disable circuit 29 including a long duration timer 95 (FIG. 9) is provided so that the timer 95 may be started whenever a protective function disable switch 28 is operated. In the example shown, a capacitor 98 is connected through a resistive element 97 to be in parallel with the Zener diode 89 (FIG. 8) and the junction between the resistive element 97 and the capacitor 98 is connected through a resistive element 99 and a light emitting element $\mathbf{101}_{PE}$ of a photocoupler 101 to one end of the protective function disable switch 28, while the other end of the switch 28 is connected to the junction 73. A photo-thyristor $\mathbf{101}_{PR}$ which acts as a light receiving element for the photocoupler 101has its anode connected to one output end 91 of the rectifying and smoothing circuit 88 and has its cathode connected through a parallel circuit 102 (FIG. 9) including a capacitor and a resistive element to the junction 73 and also connected to a power supply terminal ⑦ of the timer 95. The timer has a ground terminal ④ which is connected to the junction 73, and a capacitor 103 and a resistive element 104 are connected to the timer 95 to set up a timer interval. The timer 95 has an output terminal ② which is connected through a back flow blocking diode 105 to the base of the transistor 86. When the operating power is applied to the power supply terminal ⑦ of the timer 95, a high level is delivered to the output terminal ② for the duration of the timer interval. To give examples, the timer 95 may be commercially available ones such as a long duration timer IC from Matsushita Electric Works, AN6783, AN6784, Motorola MC14536B, for example.

The resistive element 99 has a resistance which is considerably smaller than the resistance of the resisting element 97 (FIG. 8) so that whenever the protective function disable switch 28 is turned on, the charge which is charged on the capacitor 98 through the resistive element 97 is instantaneously discharged through the resistive element 99, the light emitting element $\mathbf{101}_{PE}$ and the switch 28. The discharge current causes the light emitting element $\mathbf{101}_{PE}$ to emit light, which turns the photo-thyristor $\mathbf{101}_{PR}$ on, allowing the operating power to be applied to the power supply terminal ⑦ of the timer 95 through the photo-thyristor $\mathbf{101}_{PR}$ to operate the timer 95. The high level is delivered to the output terminal ② to be supplied through the diode 105 to the base of the transistor 86, whereupon the transistor 86 conducts to cease the light emission from the light emitting element $\mathbf{55}_{PE}$, whereupon the drive current ceases to flow through the relay coil 16C to cause the relay contact $\mathbf{16}_M$ to be thrown to the normally closed contact $\mathbf{16}_{NC}$, thus allowing the a.c. power to be supplied to the primary winding 12. Accordingly, if the power interrupting switch 16 were turned off in response to the detection of a ground fault, the current begins to flow through a site of ground fault again, and this ground fault will be detected by the ground fault detection circuit 22*a*. However, because the transistor 86 short-circuits across the light emitting element $\mathbf{55}_{PE}$ and the photo-thyristor $\mathbf{43}_{PR}$, the power interrupting switch 16 cannot be turned off.

When the time interval of the timer 95, which may be thirty minutes, for example, passes, the output from the timer 95 returns to its low level, whereupon the transistor 86 becomes nonconductive. Accordingly, as mentioned previously, the ground fault detection output from the ground fault detection circuit 22*a* turns the photo-thyristor $\mathbf{43}_{PR}$ on, whereby the power interrupting switch 16 is turned off, ceasing the supply of the a.c. power to the primary winding 12.

The purpose of the parallel circuit 107 including a resistive element and a capacitor which is connected between the gate of the photo-thyristor $\mathbf{101}_{PR}$ and the second input terminal 15 as well as the parallel circuits 56 and 77 is to prevent a malfunctioning from occurring in response to noises. The purpose of the Zener diode 53 is to provide a gate bias to each of the photo-thyristor $\mathbf{43}_{PR}$ and the thyristor 76, again in order to prevent a malfunctioning from occurring in response to noises.

A surge absorber 108 connected between the second input terminal 15 and the midpoint 41 of the secondary winding 13 is provided in order to absorb a surge voltage which may be developed between the second input terminal 15 and the ground terminal 25. The specific example shown in FIGS. 8 and 9 and described above illustrates the application to the transformer assembly with protective functions as shown in FIG. 6. For the application to the transformer assembly with protective functions as illustrated in FIG. 7, a short-circuit may be provided between the input terminals 14 and t1 as indicated in broken lines in FIG. 8, to eliminate the diode D1 and the third input terminal t1, and the lines indicated by encircled A and encircled B may be connected together.

One of the abnormality detection circuits 22*a* and 22*b* may be omitted. Alternatively, the protective function disable means 27 may be omitted. When the specific example shown in FIGS. 8 and 9 is applied to the embodiment shown in FIG. 6, the restart circuit 31, namely, the drive circuit 32 and the restoring circuit 33, may be omitted. Various arrangements may be contemplated for the abnormality detection circuit 22. To give several examples, one as disclosed in Japanese Laid-Open Patent Application No. 262,168/1999, another disclosed in U.S. Pat. No. 5,847,909 (issued Dec. 8, 1998) or a further one disclosed in U.S. Pat. No. 6,040,778 (issued Mar. 21, 2000) may be used as the ground fault detection circuit 22*a* or other abnormality detection circuit 22.

Figure 10:
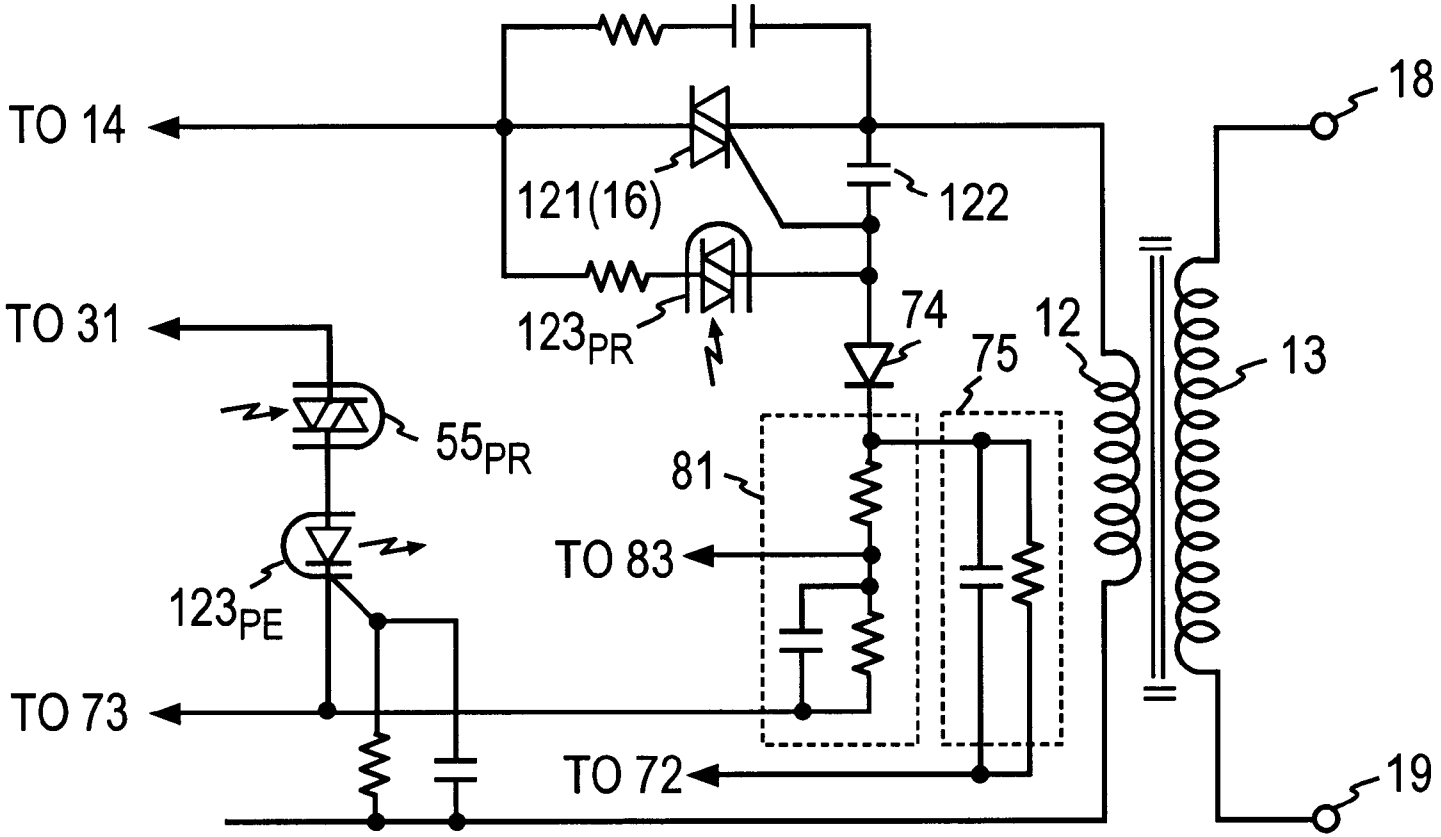
FIG. 10 is a circuit diagram of an embodiment of the present invention in which a power interrupting switch 16 comprises an electronic switch.

In the above description of the interrupter circuit 23, the power interrupting switch 16 which comprises relay contacts is turned off by driving the relay coil. However, an electronic switch may be used for the power interrupting switch 16. An essential arrangement for this example is shown in FIG. 10. Specifically, an electronic switch or triac 121 is connected as a power interrupting switch 16 between the first input terminal 14 and one end of the primary winding 12. A capacitor 122 is connected between the gate of the triac 121 and the junction between the triac 121 and the primary winding 12. A photo-triac $\mathbf{123}_{PR}$ which acts a light receiving element for a photocoupler 123 is connected between the gate of the triac 121 and the end of the triac 121 which is located toward the terminal 14. A series circuit including a photo-triac $\mathbf{55}_{PR}$ which acts as a light receiving element and a photo-thyristor $\mathbf{123}_{PE}$ which acts as a light emitting element for the photocoupler 123 is connected between the first input terminal 14 and the junction 73. Where the no ground connection abnormality detection circuit 22*b* as mentioned above is used, the junction between the photo-triac $\mathbf{123}_{PR}$ and the capacitor 122 is connected through the diode 74 to one end of the parallel circuit 75, and a required arrangement is provided in the similar manner as shown in FIGS. 8 and 9 even though such arrangement has been omitted from illustration in FIG. 10. The junction between the photo-triac $\mathbf{123}_{PR}$ and the capacitor 122 is connected through the diode 74 to the delay circuit 81. While the other arrangements have been omitted from illustration, a similar arrangement as shown in FIGS. 8 and 9 is provided.

If an abnormality is detected by the abnormality detection circuit 22 shown in FIG. 8, the photodiode $\mathbf{55}_{PE}$ emits light, whereupon the photo-triac $\mathbf{55}_{PR}$ shown in FIG. 9 conducts, allowing the photo-thyristor $\mathbf{123}_{PE}$ shown in FIG. 10 to emit light to allow the photo-triac $\mathbf{123}_{PR}$ to conduct, whereupon the triac 121 is turned off to cease the supply of the a.c. power to the primary winding 12. It will be seen that when the photodiode $\mathbf{55}_{PR}$ is turned off, the photo-thyristor $\mathbf{123}_{PE}$ is also turned off, and consequently, the photo-triac $\mathbf{123}_{PR}$ is turned off while the triac 121 is turned on, allowing the a.c. power to be supplied to the primary winding.

An embodiment according to the third aspect of the present invention will now be described with reference to FIGS. 11 and 12. It is to be noted that in FIGS. 11 and 12, parts corresponding to those shown in FIGS. 1, 4, 5, 6 and 7 are designated by like reference characters as used before without repeating their description.

An elongate rectangular magnetic core 135 is received within the transformer casing 24. The primary winding 12 is disposed at the center of a longer side while the secondary winding 13 is split into two parts 13*a* and 13*b* which are disposed on the opposite sides of the primary winding 12. The transformer casing 24 has a top plate 24*b* which serves as an upper lid. In this example, a wiring substrate 35 is disposed adjacent to and in opposing relationship to the inner surface of the top plate 24*b* at a location near a casing end plate 24*a* on which the input terminals 14 and 15 and the output terminal 19 are mounted. The protective circuit 20, the protective function disable circuit 29, and if required, the restart circuit 31 which are shown in FIG. 7 are mounted on the opposite side from the top plate 24*b* of the wiring substrate 35, and these mounted parts as well as the wiring substrate 35 are contained in a substrate casing 136 which comprises synthetic resin, leaving the side of the substrate casing 136 which is located toward the top plate 24*b* open, which is then blocked by the wiring substrate 35. The substrate casing 136 is filled with an insulating resin 137. In this example, the wiring substrate 35 is in the form of a frame, as viewed from the top plate 24*b*, as shown in FIG. 12.

Figure 11A:
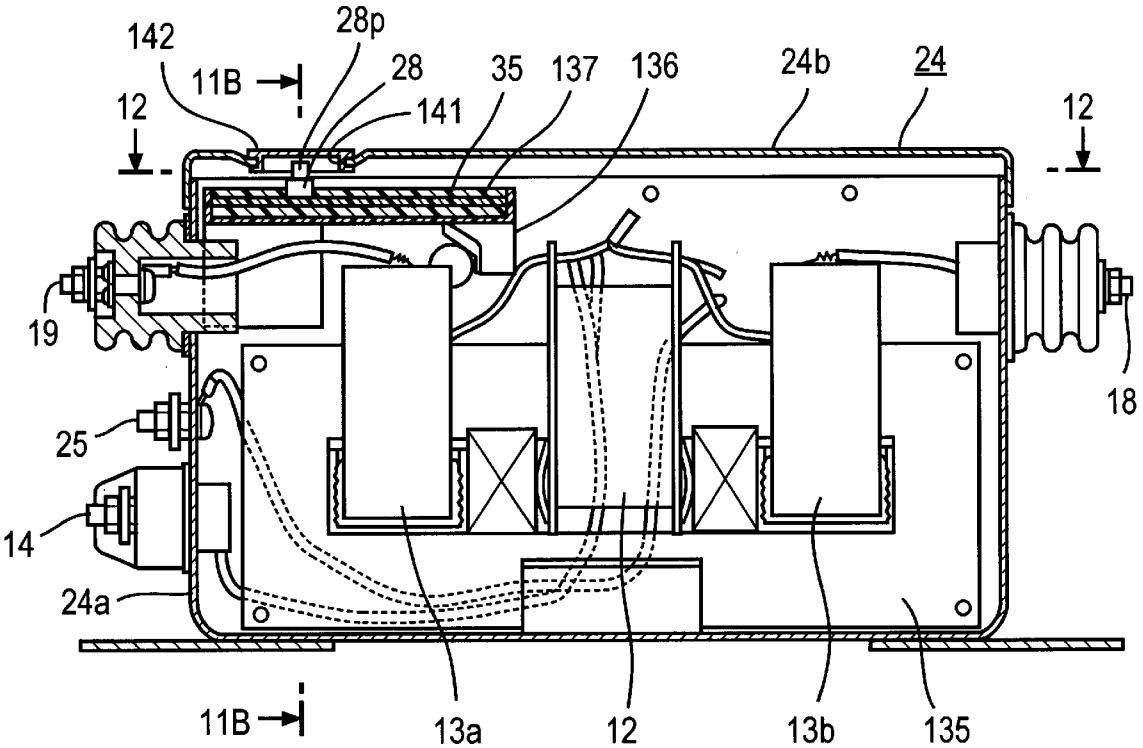
FIG. 11A is an elevational view of an embodiment according to the third aspect of the present invention where parts corresponding to a casing 24 and a substrate 35 are shown in section as taken along the line 11A—11A shown in FIG. 11B.

In this embodiment, the protective function disable switch 28 is mounted on a surface of the wiring substrate 35 which faces the casing top plate 24*b*, as shown in FIG. 11. An opening 141 is formed in the top plate 24*b* in alignment with the switch 28 and is covered by a flexible cap 142.

The protective function disable switch (operating switch) 28 has an operating knob 28*p* which projects into the opening 141 while the body of the switch 28 is partly embedded into the filler resin 137. The opening 141 is sized to allow the operating knob 28*p* to be operated as by externally pushing the flexible cap 142, and is formed to be circular as centered about the operating knob 28*p*. It is to be noted that the region of the opening 141 is located slightly inward of the remainder of the top plate 24*b* while the outer surface of the cap 142 is substantially coplanar with the top plate 24*b*. The cap 142 is formed from rubber or a pliable synthetic resin material, allowing the operating knob 28*p* to be operated by externally deforming the cap 142 utilizing the pliability thereof. The cap 142 is dish-shaped and is peripherally formed with an annular groove, into which the peripheral edge of the opening 141 is fitted to provide a water-proof structure. In other words, in this example, the cap 142 serving as an operating knob of the protective function disable switch 28 is provided on the top plate 24*b* of the transformer casing which is a surface on which the wiring terminals 14, 15, 19 and 18 are not provided.

To operate the protecting function disable switch 28, the switch operating knob 28*p* may be depressed from over the cap 142. The magnetic core 135 of the transformer is not limited to the one shown, but a variety of yokes may be used. In addition, the protective function disable switch 28 need not be provided in the top plate 24*b*, but may be provided in proximity to other inner surfaces of the transformer casing 24 on which no wiring terminals are provided. It is preferred that the operating knob 28*p* of the switch 28 be disposed as close to the inner surface of the transformer casing 24 as possible without projecting from the transformer casing 24 to allow the transformer casing 24 to be compact while facilitating the operation of the switch 28. In view of the ease of wiring of the wiring substrate 35, it may be disposed to be adjacent to and in opposing relationship with the casing top plate 24*b* in a region located close to the end plate 24*a* from which the input terminals 14, 15, the output terminal 19 and the casing ground terminal 25 project externally. In addition, the protective function disable switch 28 itself may be mounted on a surface of the transformer casing 24 other than surfaces on which the wiring terminals are mounted. In this instance, the operating knob 28*p* itself of the protective function disable switch 28 will be mounted on the transformer casing 24.

Figure 11B:
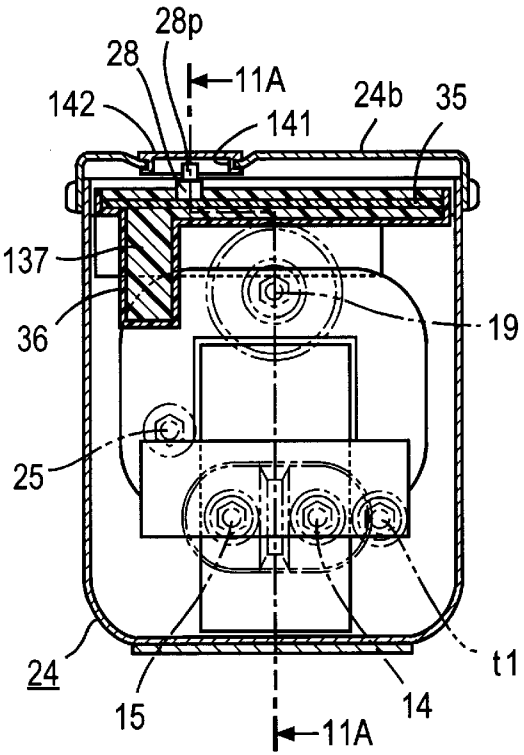
FIG. 11B is an elevational view in which parts corresponding to the casing 24 and the substrate 35 are shown in section as taken along the line 11B—11B shown in FIG. 11A.
Figure 12:
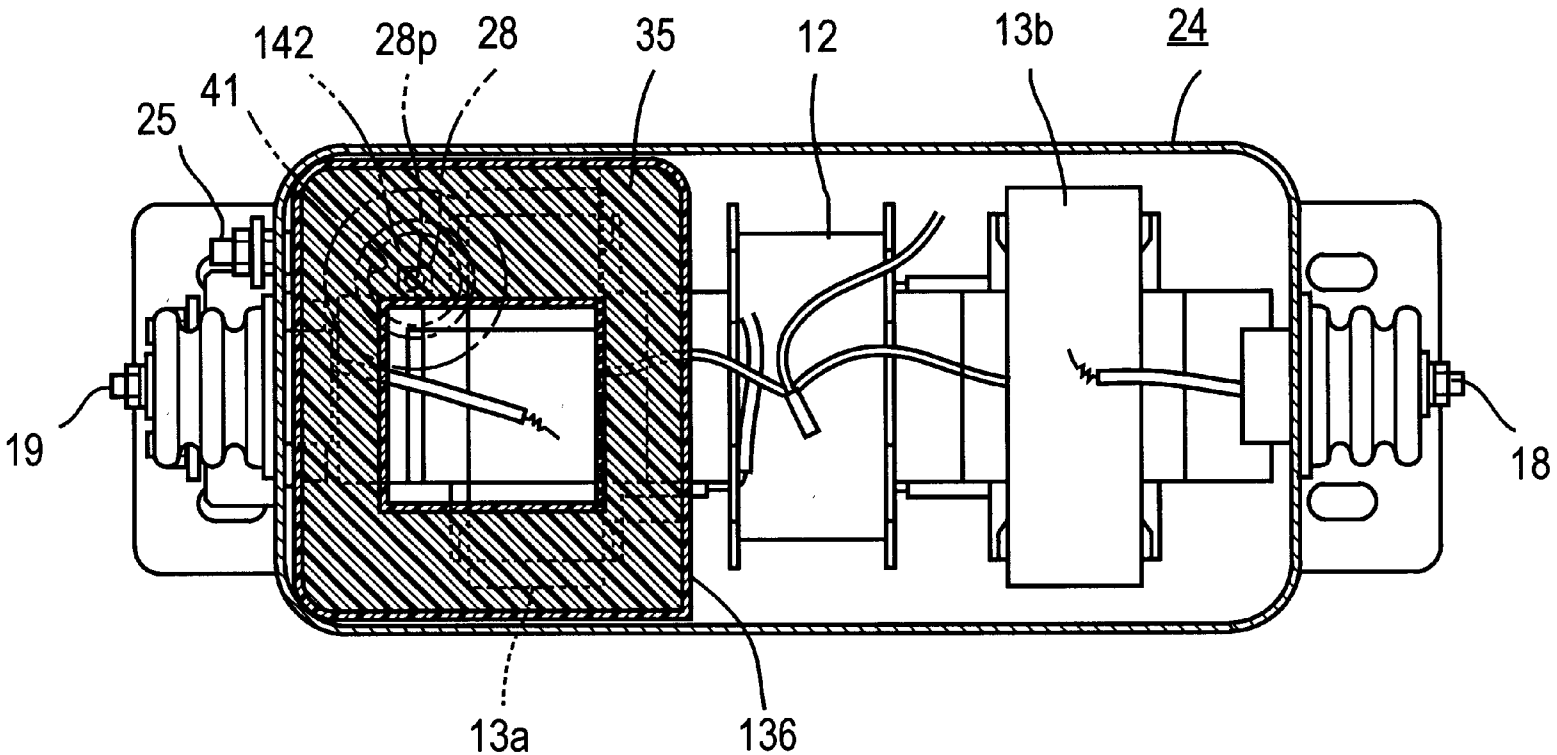
FIG. 12 is an elevational view illustrating part corresponding to the casing 24 in section as taken along the line 12—12 shown in FIG. 11.

As indicated in broken lines in FIG. 11B, the third input terminal t1 shown in FIG. 6 may be provided on the surface 24*a* of the transformer casing 24, and the interrupter circuit 23 may be connected between the third input terminal t1 and the second input terminal 15.

Figure 4:
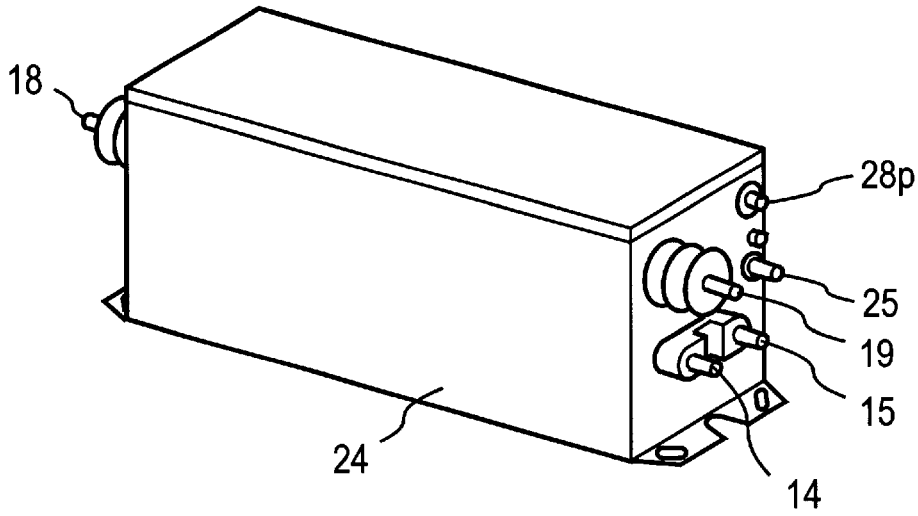
FIG. 4 PRIOR ART
FIG. 4 is a perspective view showing the appearance of the conventional sign lamp lighting transformer assembly.
Figure 5:
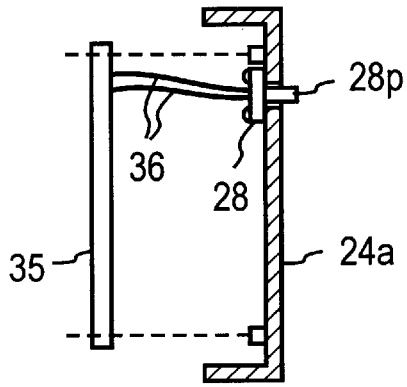
FIG. 5 PRIOR ART
FIG. 5 is an illustration of a relationship between a protective function disable switch in a conventional transformer and a wiring substrate.

With this embodiment, because an operating knob of the protective function disable switch 28 is mounted on a surface of the transformer casing 24 other than surfaces on which the wiring terminals are provided, the operation is facilitated. It is to be noted that the sign lamp lighting transformer assembly of this kind is often installed outdoors, and in such instance, it is common that a plurality of such transformer assemblies be juxtaposed within a rectangular metal box. In a conventional construction as shown in FIG. 4, a difficulty has been experienced in operating the switch knob 28*p* because of a reduced spacing left with respect to an adjacent transformer or to the wall of the metal box. However, when the operating knob of the switch 28 is mounted on the top plate 24*b* of the transformer casing 24, it is a simple matter to operate the switch 28 by removing the lid of the metal box.

Whenever a protective function disable switch 28 is mounted on the wiring substrate 35 on which the protective circuit 20 is mounted as in the described embodiment, depending on the wiring pattern on the wiring substrate 35, as the switch 28 is mounted on the wiring substrate 35, the switch 28 can be automatically connected to the protective function disable circuit 29, dispensing with a connection of the switch 28 with the protective function disable circuit 29 through the lead wire 36, thus simplifying the assembly into the transformer.

When the operating knob 28*p* of the switch 28 does not project externally, the likelihood that it moves into contact with an external object or to crash to be damaged can be reduced. Where the opening 141 is covered by the flexible cap 142 to provide a water-proof structure, there is no need for a water-proof structure for the switch 28, thus allowing an inexpensive switch to be used.

Figure 13:
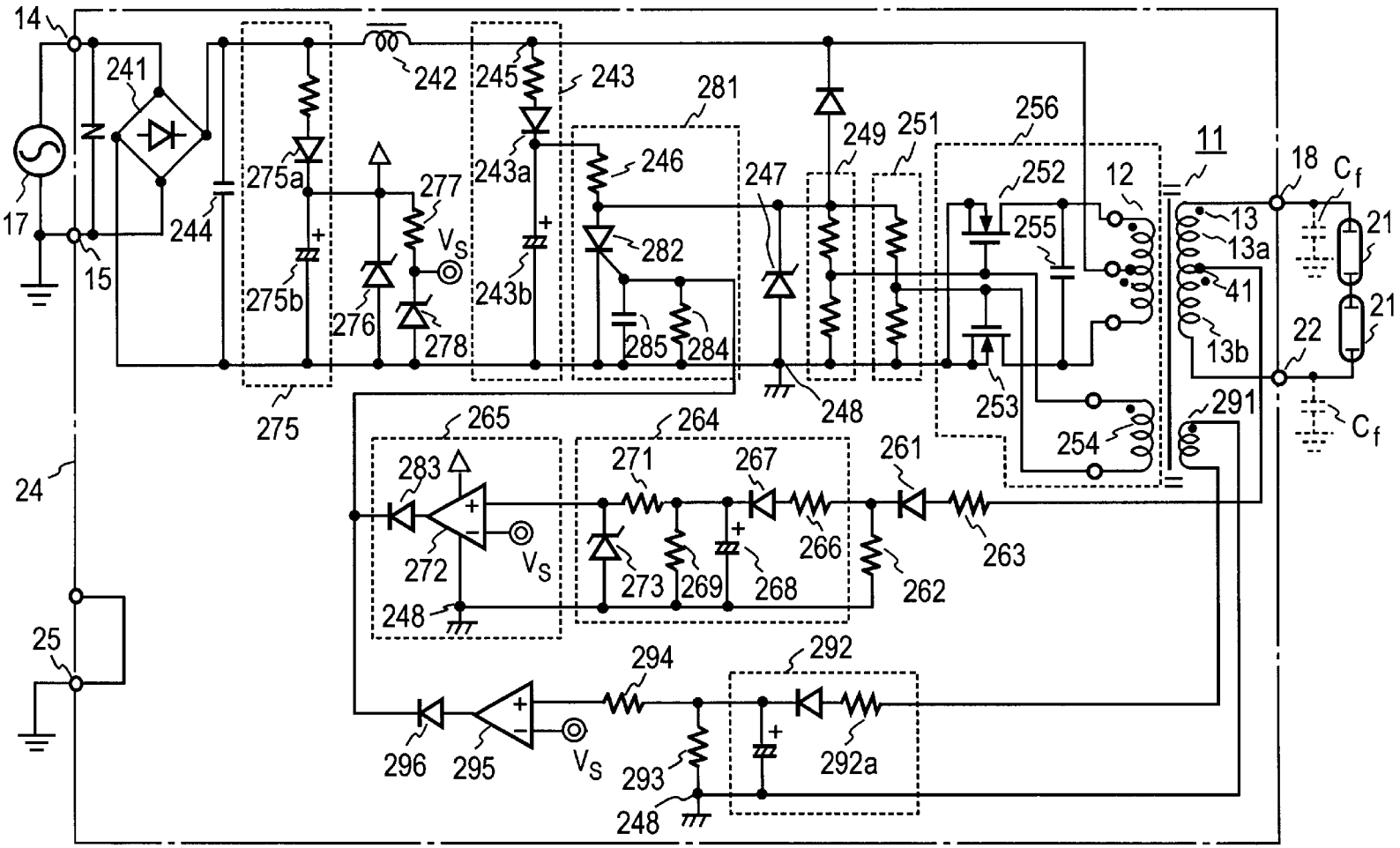
FIG. 13 is a circuit diagram of an embodiment according to the fourth aspect of the present invention.

FIG. 13 shows an embodiment according to the fourth aspect of the present invention. In this embodiment, a commercial a.c. power is converted into a high frequency power, and this is applied when lighting sign lamps with a high frequency power. Input terminals 14 and 15 which are to be connected with a commercial a.c. power source 17 are connected to the input of a full wave rectifier circuit 241, the output of which is connected through a current limiting choke coil 242 to a rectifying and smoothing circuit 243. A noise eliminating capacitor 244 is connected to the output of the full wave rectifier circuit 241, as required. The input terminal 15 is a nonactive terminal, which is to be connected to the grounded side of the commercial a.c. power source 17. A junction 245 between the choke coil 242 and the rectifying and smoothing circuit 243 is connected to the midpoint of a primary winding 12. A positive output of the rectifying and smoothing circuit 243 or a junction between a rectifier diode 243*a* and a smoothing capacitor 243*b* is connected to one end of a Zener diode 247, the other end of which is connected to a point of common potential 248 or each output end of the full wave rectifier circuit 241 and the rectifying and smoothing circuit 243. Resistive voltage dividers 249 and 251 are connected across the Zener diode 247, and each bleeder point of the voltage dividers 249 and 251 is connected to the gate of switching elements 252 and 253, respectively, each comprising an FET, to provide a given bias voltage thereto, and the both bleeder points are connected to the opposite ends of a feedback winding 254 which is magnetically coupled to the primary winding 12.

The opposite ends of the primary winding 12 are connected to the common potential point 248 through switching elements 252 and 253, respectively, and a capacitor 255 is connected across the opposite ends of the primary winding 12. The combination of the primary winding 12, the switching elements 252, 253, the feedback winding 254 and the capacitor 255 forms a self-excited oscillator circuit or so-called push-pull inverter 256. The inverter 256produces a high frequency signal having a frequency of 10 kHz to 30 kHz, for example, which is stepped up by the transformer 11 to generate a high tension output across a secondary winding 13. The high tension output is applied to sign lamps 21 to light them.

In this manner, a low frequency a.c. power such as a commercial power is subject to a full wave rectification to be converted into a d.c. power, which is then converted by the inverter 256 into a high frequency power, which is in turn stepped up by the transformer 11. The transformer 11 which is used in this instance is of a size which is considerably reduced in comparison to that shown in FIG. 1 which is used with a low frequency application.

According to the fourth aspect of the present invention, a rectifier element 261 and a resistive element 262 are connected in series between the midpoint 41 of the secondary winding 13 on the transformer 11 and the negative output terminal of the rectifier circuit 241. In the embodiment shown, the midpoint 41 of the secondary winding 13 is connected to the common potential point 248 through a resistive element 263, the rectifier element 261 and the resistive element 262. To provide a relatively high impedance through these elements located between the midpoint 41 and the common potential point 248, the resistive elements 262 and 263 have resistances of 100 kΩ and 20 kΩ, respectively, for example, so that the midpoint 41 of the secondary winding 13 on the transformer 11 is nearly ungrounded.

A current flow through the resistive element 262 is detected by a current detection circuit 264, and a decision whether or not the detected current has exceeded a given value is rendered by a decision circuit 265. In the example shown, the junction between the rectifier element 261 and the resistive element 262 is connected to the common potential point 248 through a resistive element 266, a diode 267 and a capacitor 268. The capacitor 268 is shunted by a resistive element 269, and the junction between the diode 267 and the capacitor 268 is connected through a resistive element 271 to a non-inverting input terminal of a comparator 272. The resistive elements 266 and 269 functions as a voltage divider for the voltage across the resistive element 262, and the diode 267 rectifies a voltage across the resistive element 262, and the rectified output is smoothed by the capacitor 268. The purpose of the resistive element 271 is to limit the current which is input to the comparator 272 for purpose of protecting the comparator 272, but this resistive element may be omitted.

A voltage which is developed across the resistive element 262 in accordance with a current flow through the resistive element 262 is rectified and smoothed to be applied to the comparator 272. In this manner, the value of the current which passes through the resistive element 262 is detected as a voltage value. A Zener diode 273 is connected between the non-inverting input terminal of the comparator 272 and the common potential point 248, thus protecting the comparator 272 from any overvoltage which may be input.

A rectifying and smoothing circuit 275 is connected across the output of the full wave rectifier circuit 241, and includes a smoothing capacitor 275*b*, across which a Zener diode 276 is connected. The junction between a rectifying diode 275*a* and the smoothing capacitor 275*b* is connected to a positive supply terminal of the comparator 272 while the negative supply terminal of the comparator 272 is connected to the common potential point 248. A junction between the diode 275*a* and the capacitor 275*b* is connected through a resistive element 277 to one end of a Zener diode 278, the other end of which is connected to the common potential point 248. The junction between the resistive element 277 and the Zener diode 278 is connected to the inverting input terminal of the comparator 272 to apply a reference voltage $V_s$ thereto. The decision circuit 265 is defined by the comparator 272.

When the decision circuit 265 decides that the detected current exceeds a given value, a stop circuit 281 stops the operation of the inverter 256. Specifically, the junction between the resistive element 246 and the Zener diode 247 is connected through a thyristor 282 to the common potential point 248 while the output terminal of the comparator 272 is connected through a back flow blocking diode 283 to the gate of the thyristor 282. The gate of the thyristor 282 is connected to the common potential point 248 through a parallel circuit including a resistive element 284 and a capacitor 285. A ground terminal 25 on the transformer casing 24 is connected to the ground. Accordingly, the supply of the high frequency power to the secondary winding 13 of the transformer is interrupted. The combination of the rectifier element 261, the resistive element 262, the current detection circuit 264 and the decision circuit 265 form together an abnormality detection circuit while the stop circuit 281 forms an interrupter circuit.

This embodiment is arranged so that an overvoltage of the high frequency power is detected to cease the operation of the inverter 256. At this end, an overvoltage detecting winding 291 which is magnetically coupled with the secondary winding 13 is provided on the transformer 11, and a rectifying and smoothing circuit 292 is connected across the overvoltage detecting winding 291. The rectifying and smoothing circuit 292 has a positive output which is connected through an overcurrent protecting resistive element 294 to the non-inverting input terminal of a comparator 295 and a negative output which is connected to the common potential point 248. The inverting input terminal of the comparator 295 is connected to the junction between the resistive element 277 and the Zener diode 278, and the output of the comparator 295 is connected through a back flow blocking diode 296 to the gate of the thyristor 282. The resistive element 292*a* in the rectifying and smoothing circuit 292 and the resistive element 293 form together a voltage divider.

When the described arrangement is in its normal condition, the midpoint 41 of the secondary winding 13 assumes a substantially grounded condition, and accordingly, the potential at one end of the secondary winding 13 changes from $+V_A$ to $-V_A$ while the potential at the other end of the secondary winding 13 changes from $-V_A$ to $+V_A$ at a high frequency, repeating an inverse change subsequently in a repeated manner. Accordingly, the midpoint 41 always assumes a substantially zero potential. Accordingly, the current which flows from the midpoint 41 to the common potential point 248 through the resistive element 262 is considerably small. Consequently, a voltage which corresponds to the current and which is applied to the non-inverting input terminal of the comparator 272 is less than the reference voltage $V_s$, and the comparator 272 delivers an output of a low level, and accordingly, the thyristor 282 remains nonconductive and the inverter 256 continues its oscillation.

However, when a ground fault occurs on the output side of the secondary winding 13, for example, on one of the output terminals, 18, for example, the output terminal 18 assumes a substantially ground potential while the potential at the other output terminal 19 changes substantially between $+2V_A$ and $-2V_A$ at a high frequency, and the potential at the midpoint 41 changes between $+V_A$ and $-V_A$. As a consequence, a fluctuation in the potential at the midpoint 41 is rectified by the rectifier element 261 to pass a current flow through the resistive element 262, and the voltage which corresponds to the current is detected by the detection circuit 264 to be applied to the non-inverting input terminal of the comparator 272. This voltage exceeds the reference voltage $V_s$, and hence the output of the comparator 272 changes to its high level, which is then applied through the diode 283 to the gate of the thyristor 282, rendering it conductive. Accordingly, the voltage dividers 249 and 251 are substantially short-circuited, providing a zero bias voltage to the switching elements 252 and 253, whereby the inverter 256 can no longer oscillate. No high frequency power appears across the secondary winding 13, ceasing a current flow of an increased magnitude through a site of ground fault. As a consequence, a detected voltage from the detection circuit 264 is reduced, and the output of the comparator 272 returns to its low level, but the presence of the back flow blocking diode 283 maintains the thyristor 282 conductive.

When the sign lamps 21 are lit with a high frequency power, because the power which drives the sign lamps has a high frequency, the floating capacitance $C_f$ between the wiring of the sign lamp 21 and the ground presents a relatively low impedance, allowing a leak current having a relatively large magnitude to flow to the ground. For example, when the potential at the output terminal 19 assumes $-V_A$, a leak current flows through a circuit including the midpoint41, the resistive element 263, the rectifier element 261, the resistive element 262, the common potential point 248, the nonactive input terminal 15, the ground, the floating capacitance $C_f$ and the output terminal 19. However, the presence of the rectifier element 261 prevents a current flow in the opposite direction from the leak current. This means that there is a current flow through the resistive element 262 only in one direction. By contrast, when there is no rectifier element 261, a leak current in either direction flows through the resistive element 262, and accordingly, when the leak current has a high magnitude, it may be detected as a ground fault inadvertently. However, when the rectifier element 261 is provided according to the fourth aspect of the present invention, such likelihood is avoided.

Figure 3:
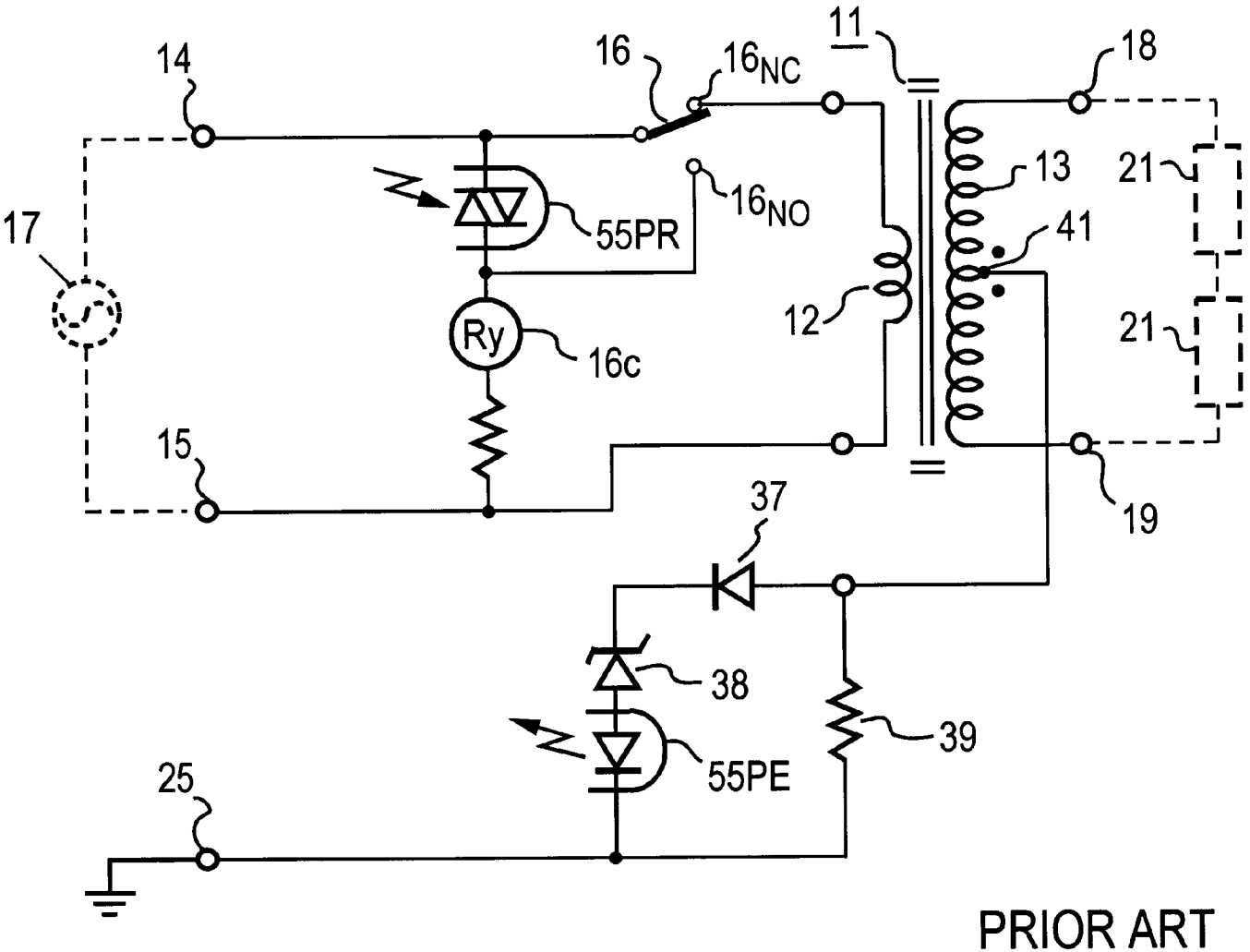
FIG. 3 is a circuit diagram of a further conventional sign lamp lighting transformer assembly with protective functions.
Figure 14A:
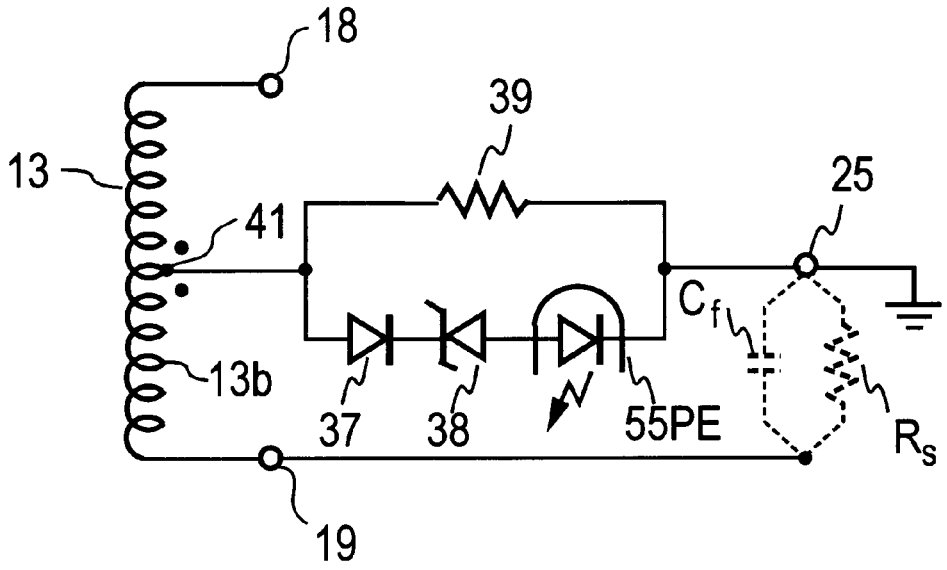
FIG. 14A shows an equivalent circuit of part of the secondary circuit of the prior art shown in FIG. 3.

Specifically, when the so-called inverter drive is applied to the transformer shown in FIG. 3 in which the commercial a.c. power is converted into a high frequency power in a range of 10 kHz to 30 kHz, for example, to light the sign lamps 21, the high frequency of the power makes the influence of the floating capacitance $C_f$ on the secondary wiring to be not negligible, and the circuit through the secondary floating capacitance $C_f$ has an equivalent circuit as shown in FIG. 14A. For example, a high frequency power induced in a secondary winding 13*b* located between the midpoint 41 and the output terminal 19 causes a leak current to flow through a closed circuit passing through a parallel circuit of the resistive element 39 and a series combination of the diode 37, the Zener diode 38 and the light emitting element $\mathbf{55}_{PE}$ and the floating capacitance $C_f$, and when the leak current has a relatively high magnitude, the Zener diode 38 will become conductive, causing the light emitting element $\mathbf{55}_{PE}$ to emit light, causing a malfunctioning.

Figure 14B:
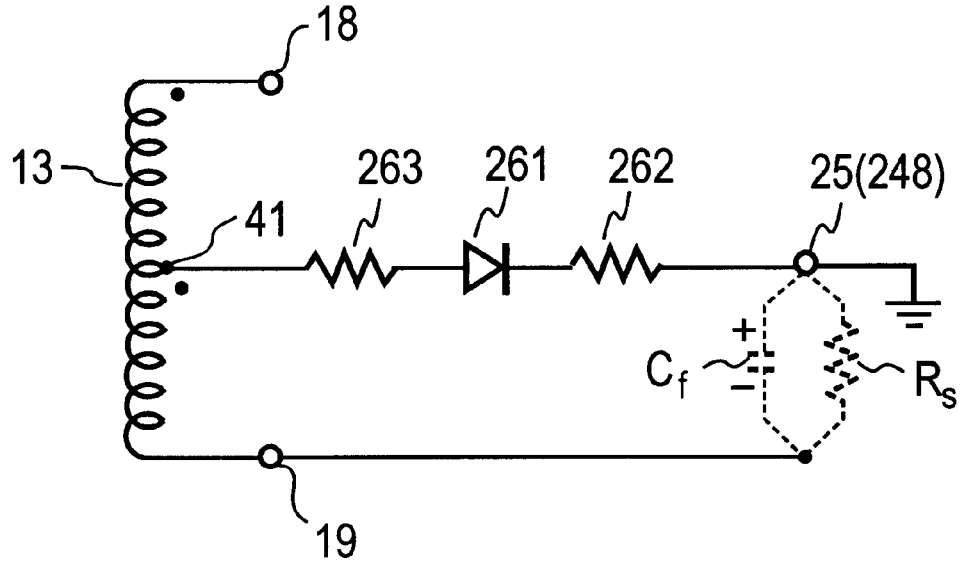
FIG. 14B shows an equivalent circuit of part of the secondary circuit of the embodiment shown in FIG. 13.

However, the embodiment shown in FIG. 13 has an equivalent circuit corresponding to that shown in FIG. 14A, which is indicated in FIG. 14B. Thus, there is no resistive element which is connected in parallel with the diode 261, and accordingly, the leak current which passes through the floating capacitance $C_f$ is rectified by the diode 261 to charge the floating capacitance $C_f$, and the charged voltage applies a reverse bias to the diode 261, and thus the voltage which is applied to the ground fault detecting resistive element 262 in response to the leak current is reduced. In the event a ground fault occurs on the side of the output terminal 19, for example, a ground fault resistance $R_s$ associated with the output terminal 19, for example, short-circuits the floating capacitance $C_f$, causing a current of an increased magnitude to flow through the resistive element 262 to increase the voltage across the resistive element 262, resulting in a larger difference over the voltage across the resistive element 262 which occurs by the leak current during the normal operation, thus enabling a ground fault to be reliably detected without any malfunctioning.

While the effect of the invention has been illustrated with respect to the output terminal 19 in FIG. 14B, it should be understood that the same is true with the output terminal 18, allowing a ground fault to be reliably detected without being influenced by the leak current.

In an alternative arrangement, the resistive element 263 may be omitted, using only the resisting element 262, but using a greater resistance, thus making the midpoint 41 to be nearly ungrounded. However, in this instance, a current having a relatively high magnitude is input to the comparator 272 through the resistive element 266, the diode 267 and the resistive element 261, presenting a likelihood that the comparator 272 may be damaged, and thus there is a need of a consideration for this likelihood in the design. Rather, it is simpler for the design to provide the resistive element 263 and choose the resistance of the resistive element 262 to be much smaller than the resistance of the resistive element 263. The diode 267 and the capacitor 268 may be omitted. However, when the diode 267 and the capacitor 268 are provided to apply a further rectification and smoothing upon the output which is rectified by the rectifier element 261, an instantaneous fluctuation in the output voltage from the detection circuit 264 can be reduced, avoiding the likelihood of a malfunctioning and improving the stability.

It will be appreciated that when the voltage of the high frequency power which appears on the secondary side of the transformer 11 becomes equal to or greater than a given value, the output voltage from the rectifying and smoothing circuit 292 increases to provide a high level output from the comparator 295, whereupon the thyristor 282 conducts to cease the operation of the inverter 256.

Figure 15:
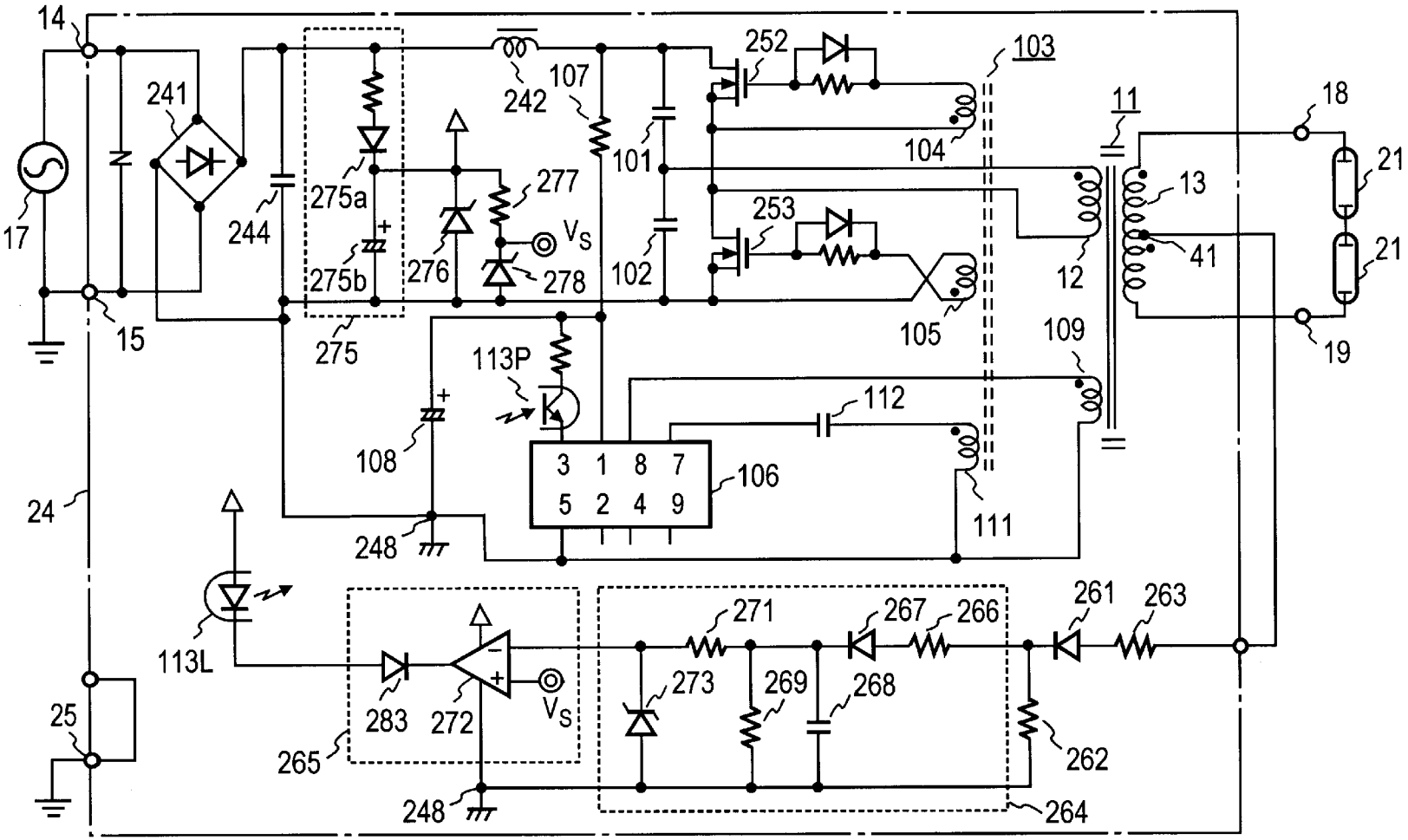
FIG. 15 is a circuit diagram of another embodiment according to the fourth aspect of the present invention.
Figure 16:
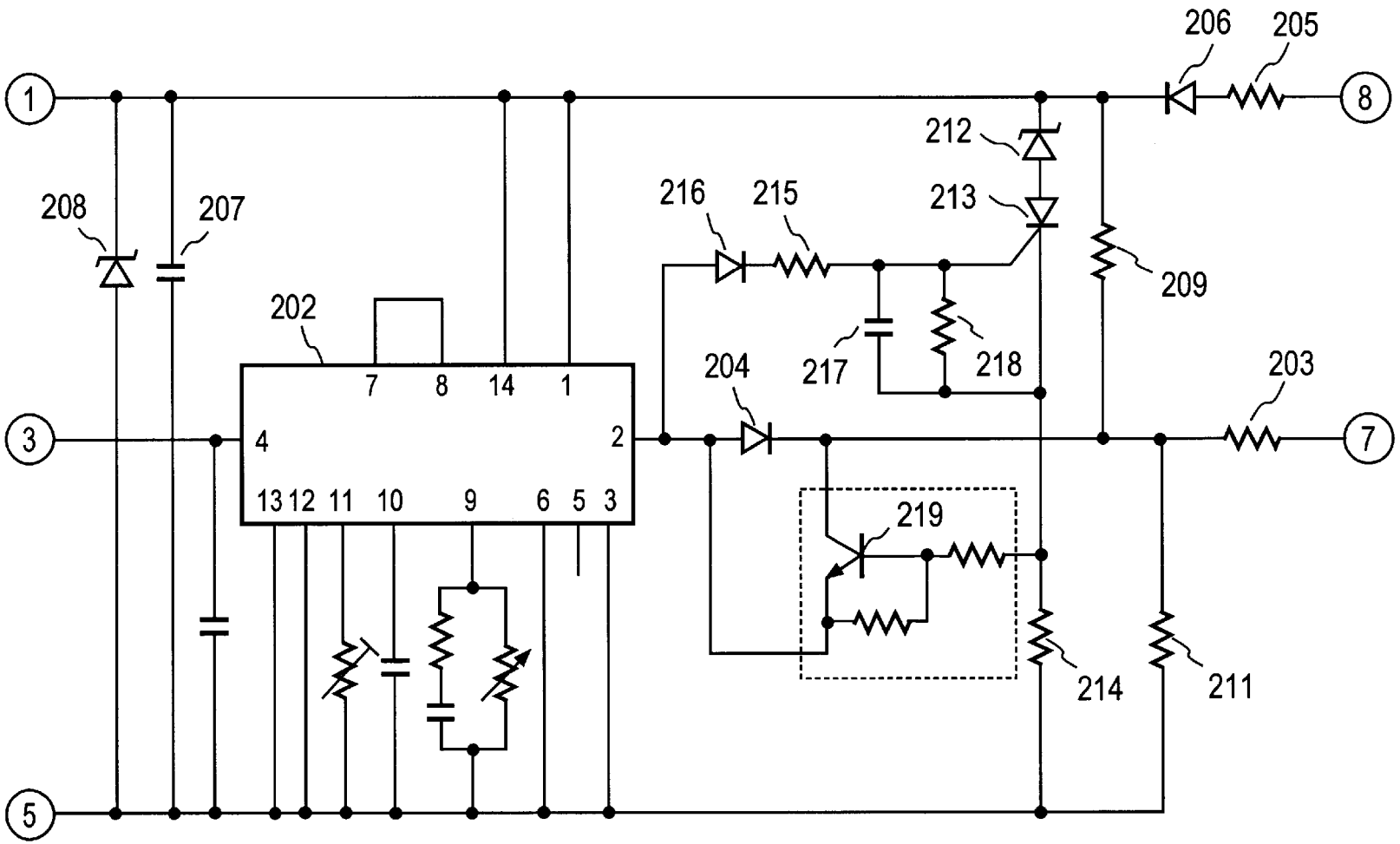
FIG. 16 is a circuit diagram showing part of an integrated circuit 106 shown in FIG. 15 in detail.

It should be understood that the inverter 256 is not limited to one using a pair of switching elements, but may comprise four switching elements. It is not limited to a self-excited type, but may be an externally-excited type. An example of externally-excited type for the inverter 256 is shown in FIG. 15. Parts corresponding to those shown in FIG. 13 are designated y like reference characters as used before. A series circuit of capacitors 101 and 102 is connected through a choke coil 242 to the output of a rectifier circuit 241, and is shunted by a series circuit of FET's 252 and 253 serving as switching elements. A pulse transformer 103 has a pair of secondary windings 104 and 105, which are connected across the gate and source of FET's 252 and 253, respectively, and a transformer 11 has a primary winding 12 which is connected between the junction between the capacitors 101 and 102 and the junction between FET's 252 and 253. It is to be noted that the secondary windings 104 and 105 of the pulse transformer 103 are connected to FET's 252 and 253 in mutually opposite polarities.

An oscillation controlling integrated circuit 106 has a pin No. 1, to which the junction between the choke coil 242 and the capacitor 101 is connected through a resistive element 107. A negative output of the rectifier circuit 241 or a common potential point 248 is connected to a pin No. 5 of the integrated circuit 106. A capacitor 108 is connected between the pins No. 1 and No. 5, and a tertiary winding 109 which is magnetically coupled with the primary winding 12 is connected between the pin No. 5 and pin No. 8 of the integrated circuit 106. The pulse transformer 103 includes a primary winding 111 which is connected through a capacitor 112 to a pin No. 7 and the common potential point 248. The integrated circuit 106 internally houses an oscillation circuit, an oscillation output of which is applied to the primary winding 111 of the pulse transformer 103, and depending on the polarity of the pulse which is applied to the primary winding 111, pulses which are induced across the secondary windings 104 and 105 control one of FET's 252 and 253 on and the other off in alternate fashion. Accordingly, the charge on the capacitors 101 and 102 flows alternately through the primary winding 12 in mutually opposite directions, whereby the output from the rectifier circuit 241 is converted into a high frequency power, which is stepped up by the transformer 11 to induce a voltage across a secondary winding 13. Part of the high frequency power is fed back from the tertiary winding 109 to the integrated circuit 106, supplying an operating power thereto.

Also in this embodiment, a midpoint 41 of the secondary winding is connected to the common potential point 248 through a rectifier element 261 and a resistive element 262, a current flow through the resistive element 262 is detected by a detection circuit 264, and a decision whether or not the detected value has exceeded a reference voltage $V_s$ is rendered by a decision circuit 265, all in the same manner as illustrated in FIG. 13. However, in the present example, an output from the detection circuit 264 is applied to an inverting input of a comparator 272, the non-inverting input of which is fed with the reference voltage $V_s$. An output from the comparator 272 is connected through a back flow blocking diode 283 and a light emitting element 113L of a photocoupler 113 to the junction between a rectifying diode 275*a* and a smoothing capacitor 275*b*. The cathode of the diode 283 is connected to the output of the comparator 272. The junction between the resistive element 107 and the capacitor 108 is connected through a light receiving element 113P of the photocoupler 113 to a pin No. 3 of the integrated circuit 106.

Under a normal condition, an output voltage from the detection circuit 264 is less than the reference voltage $V_s$, and accordingly, an output from the comparator 272 assumes a high level and a resulting current flow is blocked by the diode 283, preventing a current flow through the light emitting element 113L, which therefore cannot emit light. Consequently, the integrated circuit 106 continues its operation, allowing the high frequency power to be delivered from the transformer 11.

In the event a ground fault occurs, the output voltage from the detection circuit 264 exceeds the reference voltage $V_s$. and the output from the comparator 272 changes to a low level, whereby there occurs a current flow through the diode 283 and the light emitting element 113L, which therefore emits light, and such light is received by the light receiving element 113P, which then conducts to apply a positive voltage to the pin No. 3 of the integrated circuit 106 through the light receiving element 113P. The integrated circuit 106 then ceases to operate, and accordingly, a switching control over FET's 252 and 1253 ceases, thus interrupting the supply of the high frequency power to the secondary winding 13.

The semiconductor integrated circuit 106 may comprise a commercially available switching regulator controlling semiconductor integrated circuit 202 (such as M51996A available from Mitsubishi Electric Co., for example) in which several elements are assembled to provide a unitary package. Specifically, the pin No. 1 ① of the integrated circuit 106 is connected to pins No. 1 and No. 14 of the integrated circuit 202; the pin No. 3 ③ of the integrated circuit 106 is connected to a pin No. 4 of the integrated circuit 202; the pin No. 5 ⑤ of the integrated circuit 106 is connected to pins No.3, No. 6, No. 12 and No. 13 of the integrated circuit 202; the pin No. 7 ⑦ of the integrated circuit 106 is connected through a resistive element 203 and diode 204 to a pin No. 2 of the integrated circuit 202; the pin No. 8 ⑧ of the integrated circuit 6 is connected through a resistive element 205 and a diode 206 to pins No. 1 and No. 14 of the integrated circuit 202. A capacitor 207 and a Zener diode 208 are connected across the pins ① and ⑤, and a junction between the resistive element 203 and the diode 204 is connected through resistive elements 209 and 211 to the pins ① and ⑤, respectively. A series circuit including a Zener diode 212, a thyristor 213 and a resistive element 214 is connected across the pins ① and ⑤, and the gate of the thyristor 213 is connected through a resistive element 215 and a diode 216 to the pin No. 2 of the integrated circuit 202. A parallel circuit including a capacitor 217 and a resistive element 218 is connected across the gate and the cathode of the thyristor 213. A transistor 219 is connected across the anode and the cathode of the diode 204 in opposite polarity, and the base of the transistor 219 is connected to the cathode of the thyristor 213.

Part of the high frequency power applied to the transformer 11 is input through the tertiary winding 109 to the pin ⑧, and is rectified by the diode 206 to provide a constant supply voltage across the capacitor 207 and the Zener diode 208, thus feeding the supply pin of the integrated circuit 202. A pulse output from the integrated circuit 202 represents a positive pulse which is passed through the diode 204 to be applied to the primary winding 111 of the pulse transformer. The positive pulse is also delayed by the capacitor 217 and the resistive element 215 before being applied to the thyristor 213 to render it conductive. As a consequence, the transistor 219 is permitted to conduct, whereby the charge on the capacitor 112 is discharged through the transistor 219. The delayed operation prevents a switching control over FET's 252 and 253 from becoming unstable at the commencement of operation.

What is claimed is:

1. A sign lamp lighting transformer assembly interrupting supply of AC power from an AC power source upon detection of such an abnormality as including at least a ground fault in a secondary winding circuitry, a non-grounding fault of a transformer assembly casing or a false connection of the AC power source to the transformer assembly in reverse polarity, comprising:

a transformer having a primary winding and a secondary winding across which a sign lamp to be lit is connected;

a first and a second input terminal which are adapted to be connected to a first and a second terminal of the AC power source respectively, either directly or through a flasher;

a power interrupting switch which is normally closed and connected in series between the first input terminal and one end of the primary winding of the transformer, said second input terminal being connected to opposite ends of the primary winding of the transformer;

a third input terminal connected directly to the first terminal of the AC power source;

an abnormality detection circuit detecting said abnormality; and an interrupter circuit turning the power interrupting switch from its normally "on" condition to its "off" condition in response to an output from the abnormality detection circuit which represents detection of said abnormality, to thereby cause interruption of the supply of the AC power to the transformer, wherein said interrupter circuit is connected between the second and third input terminals so that said interrupter circuit is continuously supplied with the AC power irrespective of interruption of the supply of the AC power to the transformer.

2. The sign lamp lighting transformer assembly according to claim 1, further comprising:

a diode connected between the first input terminal and the third input terminal and forwardly poled from the first input terminal to the third input terminal.

3. The sign lamp lighting transformer assembly according to claim 1, further comprising a switch connecting directly between the first input terminal and the third input terminal.

4. The sign lamp lighting transformer assembly according to claim 1, further comprising:

a restart circuit rendered operative when the power interrupting switch is turned to its "off" condition to control the interrupter circuit to its restored condition temporally so that the power interrupting switch is automatically restored to its "on" condition only once.

5. The sign lamp lighting transformer assembly according to claim 4 in which the restart circuit comprises:

a drive circuit including a delay circuit and a capacitor connected in series in a current path, the drive circuit being operative by connection with the first input terminal whenever the power interrupting switch is turned off to allow a charging current for the capacitor to be produced with a short time delay which is determined by the delay circuit, thereby generating a drive signal which corresponds to the charging current; and a restoring circuit connected with the drive circuit and responsive to the drive signal to control the interrupted circuit so as to restore the power interrupting switch which is turned off to its "on" condition as long as the drive signal continues to flow.

6. The sign lamp lighting transformer assembly according to claim 5, further comprising:

a protective function disable switch;

and a protective function disable circuit including a timer and activated in response to an operation of the protective function disable switch to supply the drive signal to the restoring circuit in response to the timer output over the duration of the timer.

7. A sign lamp righting transformer assembly interrupting supply of AC power from an AC power source upon detection of such an abnormality as including at least a ground fault in a secondary winding circuitry, a non-grounding fault of a transformer assembly casing or a false connection of the AC power source to the transformer assembly in reverse polarity, comprising:

a transformer having a primary winding and a secondary winding across which a sign lamp to be lit is connected;

a first and a second input terminal which can be connected across the AC power source and which are connected to opposite ends of the primary winding;

a power interrupting switch connected in series between the first input terminal and one end of the primary winding of the transformer;

an abnormality detection circuit detecting said abnormality;

an interrupter circuit turning the power interrupting switch from its "on" condition to its "off" condition in response to an output from the abnormality detection circuit which represents detection of said abnormality; and a restart circuit rendered operative when the power interrupting switch is turned to its "off" condition to control the interrupter circuit to its restored condition temporally so that the power interrupting switch is automatically restored to its "on" condition only once.

8. The sign lamp lighting transformer assembly according to claim 7, in which the restart circuit comprises:

a drive circuit including a delay circuit and a capacitor connected in series in a current path, the drive circuit being operative by connection to the first input terminal whenever the power interrupting switch is turned off to allow a charging current for the capacitor to flow with a short time delay which is determined by the delay circuit, thereby producing a drive signal which corresponds to the charging current;

and a restoring circuit connected to the drive circuit to control the interrupter circuit in accordance with the drive signal so that the power interrupting switch which is turned off is restored to its on condition as long as the drive signal is flowing.

9. The sign lamp lighting transformer assembly according to claim 8, further comprising:

a protective function disable switch;

and a protective function disable circuit including a timer and activated by an operation of the protective function disable switch to supply the drive signal to the restoring circuit in response to timer output over the duration of the timer.

10. A sign lamp lighting transformer assembly interrupting supply of AC power from an AC power source upon detection of such an abnormality as including at least a ground fault in a secondary winding circuitry, a non-grounding fault of transformer assembly casing or a false connection of the AC power source to the transformer assembly in reverse polarity, comprising:

a transformer having a primary winding and a secondary winding;

a transformer casing in which the transformer is received;

a first and a second input terminal mounted on the transformer casing and which can be connected across the AC power source and which are connected to opposite ends of the primary winding;

a first and a second input terminal mounted on the transformer casing and connected to opposite ends of the secondary winding to allow a connection with the sign lamp;

a power interrupting switch received in the transformer casing and connected in series between the first input terminal and one end of the primary winding of the transformer;

an abnormality detection circuit received in the transformer casing and detecting said abnormality;

an interrupter circuit received in the transformer casing and turning the power interrupting switch from its "on" condition to its "off" condition in response to an output from the abnormality detection circuit which represents detection of said abnormality;

an operating knob for a protective function disable switch mounted on a surface of the transformer casing other than surfaces on which the first and the second input terminal, and the first and the second output terminal are mounted; and a protective function disable circuit received in the transformer casing and operative as the operating knob is operated to cease the functioning of either one of the interrupter circuit and the abnormality detection circuit so that the power interrupting switch which is turned to its "off" condition is restored to its "on" condition.

11. The sign lamp lighting transformer assembly according to claim 10, further comprising a wiring substrate on which at least the protective function disable switch and the protective function disable circuit are mounted and disposed adjacent to and in opposing relationship with the inner surface of the surface of the transformer casing on which the operating knob is mounted, the protective function disable switch being disposed in opposing relationship with the operating knob, an opening being formed in the transformer casing opposite to the protective function disable switch, the opening being formed so as to exhibit a flexibility and covered by a cap which allows an operating element of the protective function disable switch to be controlled from the exterior so as to serve as the operating knob.

12. The sign lamp lighting transformer assembly according to claim 10 in which the transformer casing as one end face on which the first and the second input terminal and the first output terminal are mounted and the other end face on which the second output terminal is mounted and having a top surface on which the operating knob is mounted.

13. The sign lamp lighting transformer assembly according to claim 10, further comprising a restart circuit connected to the interrupter circuit and operative as the power interrupting switch is turned off to control the interrupter circuit so that the power interrupting switch is automatically restored to its "on" condition only once.

14. The sign lamp lighting transformer assembly according to claim 13 in which the restart circuit comprises:

a drive circuit including a delay circuit and a capacitor connected in series in a current path and operative by connection with the first input terminal as the power interrupting switch is turned of to allow a charging current for the capacitor to flow with a short time delay which is determined by the delay circuit, thereby producing a drive signal which corresponds to the charging current;

and a restoring circuit connected to the drive circuit for controlling the interrupter circuit in accordance with a drive signal so that the power interrupting switch which has been turned off is restored to its "on" condition as long as the drive signal is flowing.

15. The sign lamp lighting transformer assembly according to claim 14, further comprising:

a protective function disable switch;

and a protective function disable circuit including a timer and activated by an operation of the protective function disable switch to supply the drive signal to the restoring circuit in response to timer output over the duration of the timer.

16. The sign lamp lighting transformer assembly according to claim 10, further comprising:

a third input terminal mounted on a surface of the transformer casing other than the surface on which the operating knob is mounted and allowing the AC power source to be connected between the second input terminal and the third input terminal.

17. A sign lamp lighting transformer assembly interrupting the supply of the power upon detection of a ground fault, comprising:

a transformer including primary winding and a secondary winding across which a sign lamp to be lit is connected;

a first and a second input terminal across which an AC power source is connected;

an inverter connected between the first and the second input terminals and the primary winding for converting the AC power into a DC power through a rectifier circuit and for converting the DC power into a high frequency power having a higher frequency than the frequency of the AC power;

an abnormality detection circuit including a rectifier element and a first resistive element connected in series between the midpoint of the secondary winding and the negative output terminal of the rectifier circuit, a current detection circuit for detecting a current flow through the first resistive element, and a decision circuit for deciding whether or not the detected current is equal to or greater than a given value; and an interrupter circuit ceasing the operation of the inverter to interrupt the supply of the power to the transformer in response to an output from the abnormality detection circuit representing a detected normality for which the decision circuit has decided that the detected current is equal to or greater than the given value.

18. The sign lamp lighting transformer assembly according to claim 17, further comprising:

a second resistive element having a resistance less than the resistance of the first resistive element and connected in series with a rectifier element.

19. The sign lamp lighting transformer assembly according to claim 18 in which the current detection circuit comprises a rectifying and smoothing circuit which is connected across the first resistive element and includes a first rectifier element and a second rectifier element which rectifies and smoothes a voltage generated across the first resistive element, thus delivering a rectified and smoothed output voltage to the decision circuit.

20. A sign lamp lighting transformer assembly for interrupting supply of AC power from an AC power source upon detection of such an abnormality as including at least a ground fault in a secondary winding circuitry, a non-grounding fault of a transformer assembly casing or a false connection of the AC power source to the transformer assembly in reverse polarity, comprising:

a transformer having a primary winding and a secondary winding across which a sign lamp to be lit is connected;

a first input terminal adapted to be connected either directly or through a flasher to one terminal of the AC power source;

a power interrupting switch connected in series between the first input terminal and one terminal of the primary winding of the transformer;

a second input terminal adapted to be connected to the other terminal of the AC power source and the other terminal of the primary winding;

a third input terminal adapted to be directly connected to said one terminal of the AC power source when said first input terminal is connected to said one terminal of the AC power source through said flasher;

connection means for connecting said second input terminal to the first input terminal when said first input terminal is directly connected to said one terminal of the AC power source;

an abnormality detection circuit detecting said abnormality; and an interrupter circuit connected between the second and third input terminals and turning the power interrupting switch from its normally "on" condition to its "off" condition in response to detection of said abnormality by the abnormality detection circuit, to thereby cause interruption of the supply of the AC power to the transformer, while the supply of the AC power to said interrupter circuit is maintained through the third input terminal irrespective of interruption of the supply of the AC power to the transformer.

21. The sign lamp lighting transformer assembly according to claim 20, wherein said connection means comprises a diode connected between the first input terminal and the third input terminal and forwardly poled from the first input terminal to the third input terminal.

22. The sign lamp lighting transformer assembly according to claim 20, wherein said connection means comprises a switch which is adapted to be actuated to connect directly between the first input terminal and the third input terminal when the first input terminal is directly to the first terminal of the AC power source.

23. The sign lamp lighting transformer assembly according to claim 20, further comprising a restart circuit rendered operative when the power interrupting switch is turned to its "off" condition to control the interrupter circuit to its restored condition temporally so that the power interrupting switch is automatically restored to its "on" condition only once.

* * * * *